US010544710B2

(12) United States Patent
Crowe

(10) Patent No.: US 10,544,710 B2
(45) Date of Patent: Jan. 28, 2020

(54) HYDRAULIC CIRCUIT FOR VALVE DEACTIVATION

(71) Applicant: Ford Global Technologies, LLC, Dearborn, MI (US)

(72) Inventor: Jonathan Denis Crowe, Northville, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 1150 days.

(21) Appl. No.: 14/665,448

(22) Filed: Mar. 23, 2015

(65) Prior Publication Data

US 2016/0281551 A1 Sep. 29, 2016

(51) Int. Cl.
*F01L 1/18* (2006.01)

(52) U.S. Cl.
CPC ..... *F01L 1/18* (2013.01)

(58) Field of Classification Search
CPC . F01L 13/0005; F01L 1/18; F01L 1/24; F01L 2013/105; F01L 2800/00
USPC ..... 123/90.16, 90.52, 90.59
See application file for complete search history.

(56) References Cited

U.S. PATENT DOCUMENTS

| | | | |
|---|---|---|---|
| 5,544,548 | A | 8/1996 | Ihara et al. |
| 6,196,175 | B1 | 3/2001 | Church |
| 6,230,668 | B1 | 5/2001 | Marsh et al. |
| 6,584,951 | B1 | 7/2003 | Patel et al. |
| 6,758,175 | B2 | 7/2004 | Dinkel et al. |
| 6,976,463 | B2 | 12/2005 | Spath et al. |
| 7,047,925 | B2 | 5/2006 | Hendriksma et al. |
| 7,174,866 | B2 | 2/2007 | Hildebrandt |
| 7,174,869 | B2 | 2/2007 | Proschko et al. |
| 7,946,262 | B2 | 5/2011 | Borraccia et al. |

(Continued)

FOREIGN PATENT DOCUMENTS

| | | | | |
|---|---|---|---|---|
| EP | 1568851 A1 | | 8/2005 | |
| EP | 1892387 A1 | | 2/2008 | |
| GB | 1293090 A | * | 10/1972 | ..... B60T 8/1831 |

OTHER PUBLICATIONS

Pietrzyk, P. et al.,"Method and System for Variable Cam Timing Device," U.S. Appl. No. 14/520,174, filed Oct. 21, 2014, 98pages.

(Continued)

*Primary Examiner* — Mark A Laurenzi
*Assistant Examiner* — Paul W Thiede
(74) *Attorney, Agent, or Firm* — Geoffrey Brumbaugh; McCoy Russell LLP

(57) ABSTRACT

Methods and systems are provided for removing entrapped air from oil flowing within a valve deactivation hydraulic circuit of an engine. In one example, the system may include a cylinder head cap, a variable displacement engine oil control valve (VDE OCV), a variable control timing oil control valve (VCT OCV), a rocker arm, a switch of the rocker arm, a pressure relief valve and a switch of the pressure relief valve, the cylinder head cap having an inbound interior surface of the cylinder head cap, the valve deactivation hydraulic circuit having a switching gallery and a hydraulic lash adjuster oil gallery. The hydraulic lash adjuster oil gallery may provide oil pressure communication to the switching gallery, the hydraulic lash adjuster oil gallery, the switch of the rocker arm, the switch of the pressure relief valve, the VDE OCV, and the VCT OCV.

7 Claims, 7 Drawing Sheets

(56) References Cited

U.S. PATENT DOCUMENTS

| | | | | |
|---|---|---|---|---|
| 8,464,675 | B2 | 6/2013 | Waters et al. | |
| 8,640,664 | B2 | 2/2014 | Lee | |
| 8,662,035 | B1 | 3/2014 | Hendriksma | |
| 8,695,551 | B2 | 4/2014 | Langewisch et al. | |
| 2008/0035085 | A1* | 2/2008 | Hendriksma ..... | F01L 13/0005 123/90.16 |
| 2014/0245735 | A1 | 9/2014 | Kuske et al. | |
| 2014/0283776 | A1 | 9/2014 | Smith et al. | |
| 2014/0290608 | A1 | 10/2014 | Radulescu | |

OTHER PUBLICATIONS

McConville, G. "External Oil Groove on a Hydraulic Lash Adjuster," U.S. Appl. No. 14/698,493, filed Apr. 28, 2015, 56 pages.

Beyer, T. et al. "Hydraulic Circuit for Valve Deactivation," U.S. Appl. No. 14/740,011, filed Jun. 15, 2015, 52 pages.

* cited by examiner

HYDRAULIC CIRCUIT FOR VALVE DEACTIVATION

FIELD

The present description relates generally to valve actuating mechanisms for engines.

BACKGROUND/SUMMARY

Variable displacement engines may employ a valve deactivation assembly including a rolling finger follower that is switchable from an activated mode to a deactivated mode. One method for activating and deactivating the rocking arm includes an oil-pressure actuated latch pin within the inner arm of the rolling finger follower. In a first mode, the pin engages the inner arm and outer arm in a latched condition to actuate motion of the outer arm, thereby moving a poppet valve that controls one of the intake or exhaust of gases in the combustion chamber. In a second mode, the inner arm is disengaged from the outer arm in an unlatched condition, and the motion of the inner arm is not translated to the poppet valve.

Mode transitions, either from the latched condition to the unlatched condition, or vice versa, may be designed to occur only when the cam is on the base circle portion. For example, mode transitions may be controlled to occur only when the roller follower is engaging the base circle portion of the cam. This ensures that the mode change occurs while the valve deactivator assembly, and more specifically the latching mechanism, is not under a load.

Due to the high rotational speed of a cam, it may be difficult to reduce the amount of time needed to transition from a latched condition to an unlatched condition in order to execute the transition during a single base circle period. The inventors have recognized that one problematic issue that may arise during mode transitions in a rolling finger follower with an oil-pressure actuated latch pin is the presence of air within the latch pin circuit, which is compressible and increases the amount of time needed to switch from the latched condition to the unlatched condition or vice versa.

The latch pin hydraulic circuit of a switching rolling finger follower may be primed with a low amount of hydraulic pressure while operating in the latched condition to facilitate the transition to the unlatched condition. In one example, this priming is achieved by utilizing a dual-function hydraulic lash adjuster (HLA) which is configured to provide hydraulic fluid to a latch pin hydraulic circuit at one of a first, lower pressure or a second, higher pressure. The first and second pressures are provided to the hydraulic lash adjuster via respective first and second ports, and the lash adjuster directs the hydraulic fluid to the latch pin hydraulic circuit via a single port. One example of such a hydraulic lash adjuster is shown by Smith et al. in U.S. 2014/0283776. The hydraulic lash adjuster may be included within a valve deactivation hydraulic circuit that provides a lower hydraulic pressure to the first HLA port via a first hydraulic gallery whenever the engine is running, and selectively provides a higher hydraulic pressure to the second HLA port via a second hydraulic gallery when an unlatched condition is desired. The higher hydraulic pressure is above a threshold pressure for switching the state of the latching mechanism within the latch pin hydraulic chamber. The lower hydraulic pressure may be supplied via a dedicated HLA supply, while the higher hydraulic pressure may be selectively supplied by energizing a dedicated variable displacement engine oil control valve (VDE OCV). The priming of the switching gallery may be achieved by routing at least a portion of the HLA hydraulic pressure through a hydraulic flow restrictor coupling the first and second hydraulic galleries. In this way, an amount of hydraulic pressure, less than the threshold switching pressure, is present within the second hydraulic gallery when the VDE OCV is de-energized, allowing for a quicker transition to an unlatched condition upon energizing the VDE OCV.

However, the inventors herein have also recognized potential issues with such systems, particularly with regard to the issue of air entrapment in the oil. As one example, pockets of air may be introduced to the higher pressure hydraulic gallery when the engine is not running. Upon energizing the VDE OCV for valve deactivation, this air may be directed to the HLA and/or the latch pin hydraulic circuit along with the high pressure hydraulic fluid. This entrapped air can interfere with oil compression within the latch pin hydraulic circuit, thereby increasing the mode transition time in an unpredictable manner. The resulting longer and/or unpredictable mode transition times are undesirable.

In one example, the issues described above may be addressed by a method for an engine valve deactivation mechanism, comprising supplying a first oil pressure to each of a switch of a rocker arm and a pressure relief valve via a priming gallery and a hydraulic lash adjuster oil gallery; and selectively supplying a second oil pressure, greater than the first oil pressure, to the switch of the rocker arm via the hydraulic lash adjuster oil gallery. In this way, if the priming gallery is coupled to the hydraulic lash adjuster oil gallery, air entrapped within the hydraulic lash adjuster oil gallery may be expelled from the valve deactivation hydraulic circuit via the priming gallery and the pressure relief valve, thereby reducing mode transition times and increasing the predictability of the mode transition times.

As one example, the dedicated priming gallery may run parallel to the switching gallery, and may be coupled to the high pressure HLA gallery via a perpendicular drilling located toward a rear end of a cylinder head. By positioning the drilling immediately upstream of the couplings between the high pressure HLA gallery and the hydraulic lash adjusters, air may be diverted from the high pressure gallery before reaching the hydraulic lash adjusters, thereby improving the response times for valve deactivation. The dedicated priming gallery may receive a small hydraulic pressure from a dedicated hydraulic flow restrictor incorporated into the distal end of a VCT OCV valve body. By incorporating the restrictor into an annular clearance defined by an outer diameter of the valve body and an inner diameter of a mating bore of the valve body, which are both machined with tight tolerances, a controlled amount of pressure may be supplied to the priming gallery. In this way, the high pressure HLA gallery may be reliably purged of air.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
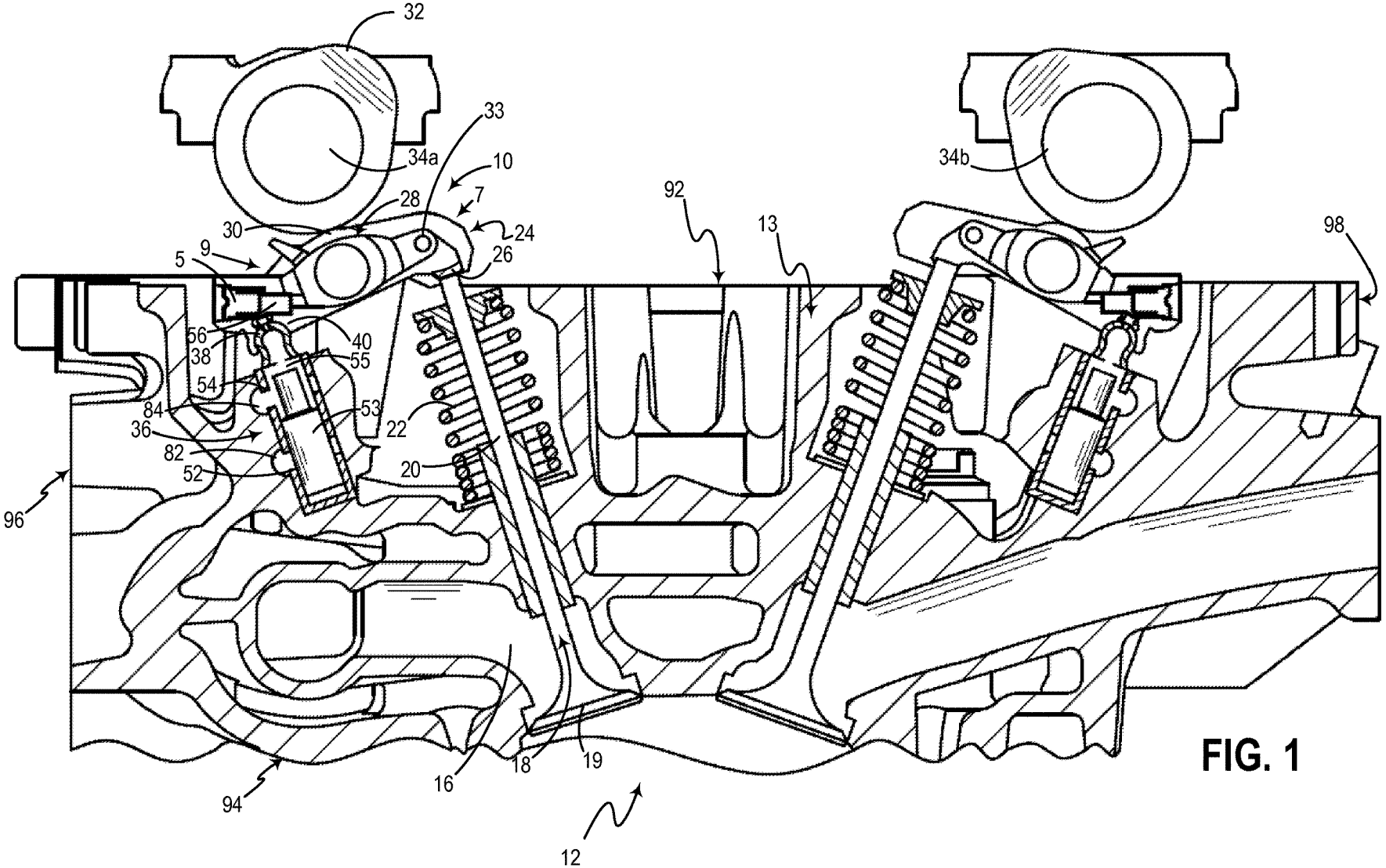
FIG. 1 depicts a hydraulic lash adjuster in fluid communication with a latch pin hydraulic chamber of a switching roller finger follower.
Figure 2A:
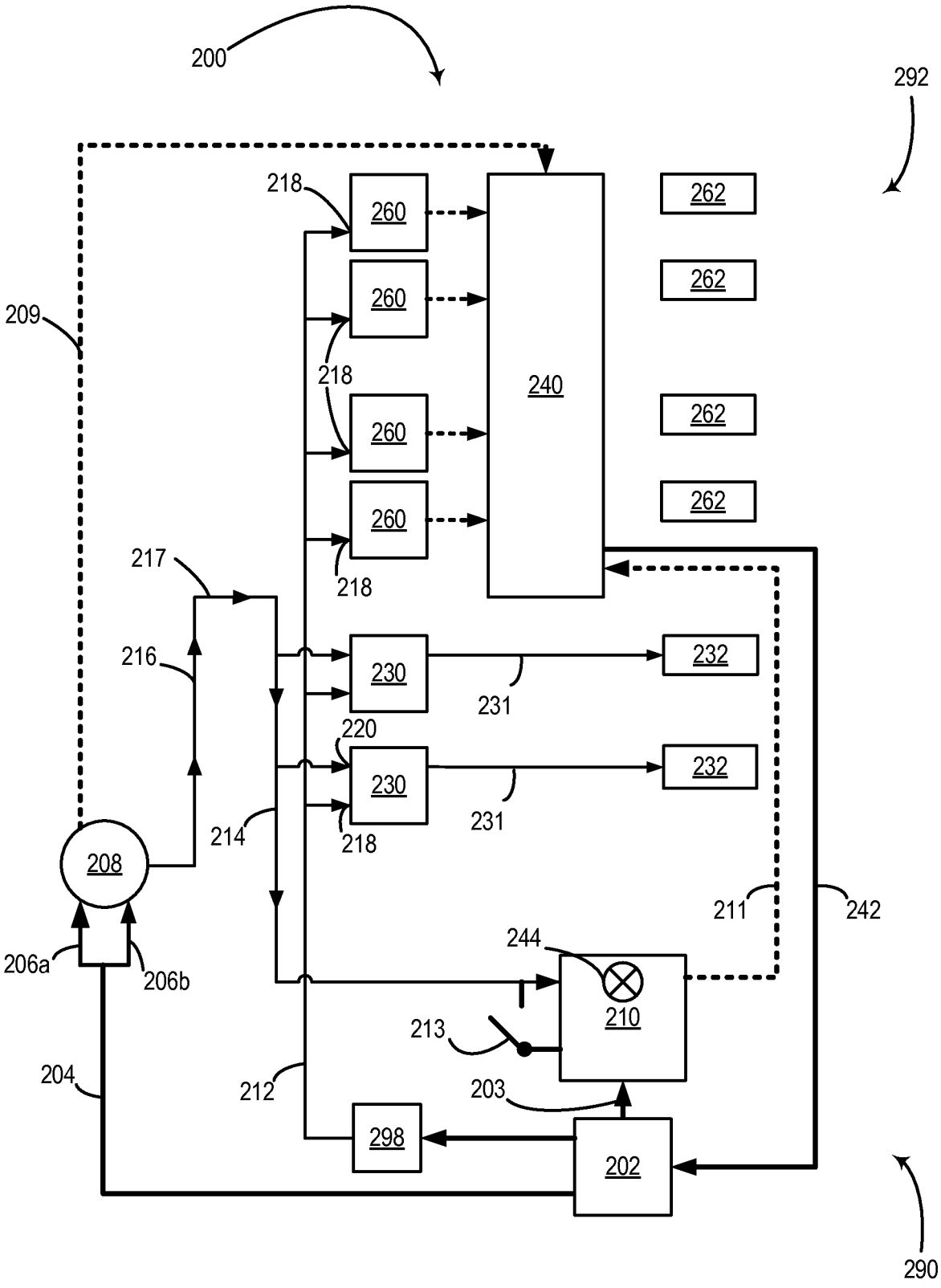
FIG. 2A provides a block diagram of a hydraulic circuit for activating and deactivating a switching roller finger follower operating in a first mode.
Figure 2B:
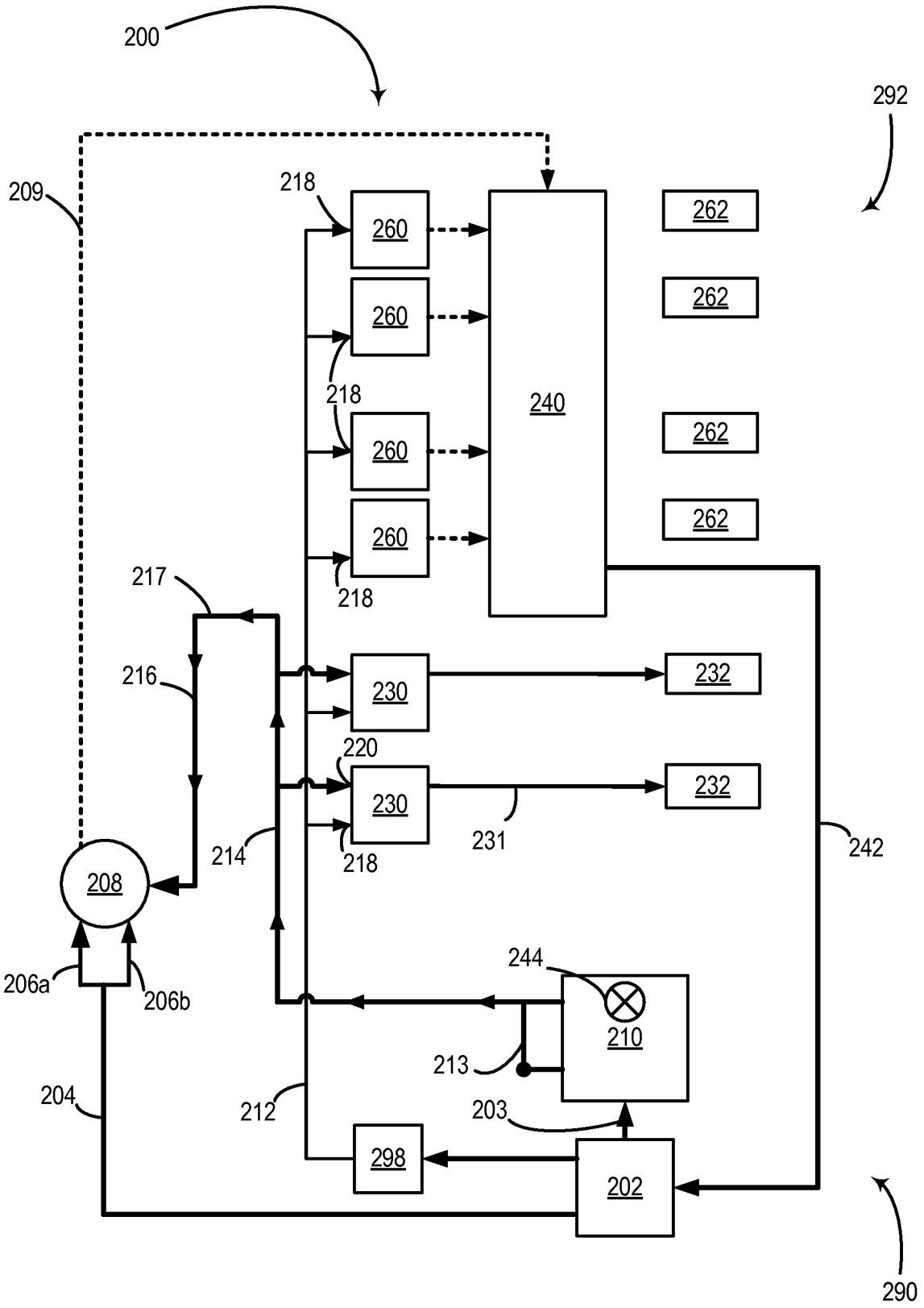
FIG. 2B provides a block diagram of a hydraulic circuit for activating and deactivating a switching roller finger follower operating in a second mode.
Figure 3A:
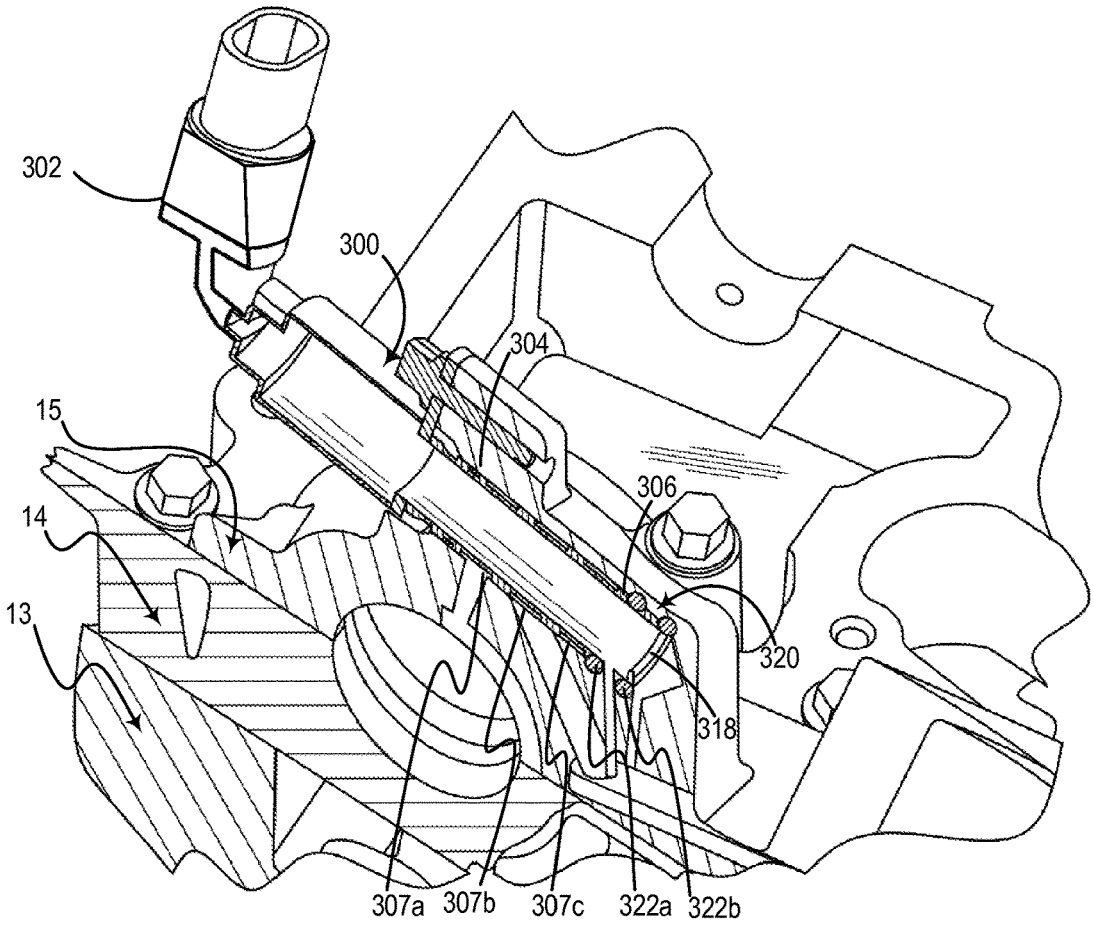
FIG. 3A shows a hydraulic flow restrictor incorporated within a clearance between a VCT OCV valve body and a mating bore of the VCT OCV.
Figure 3B:
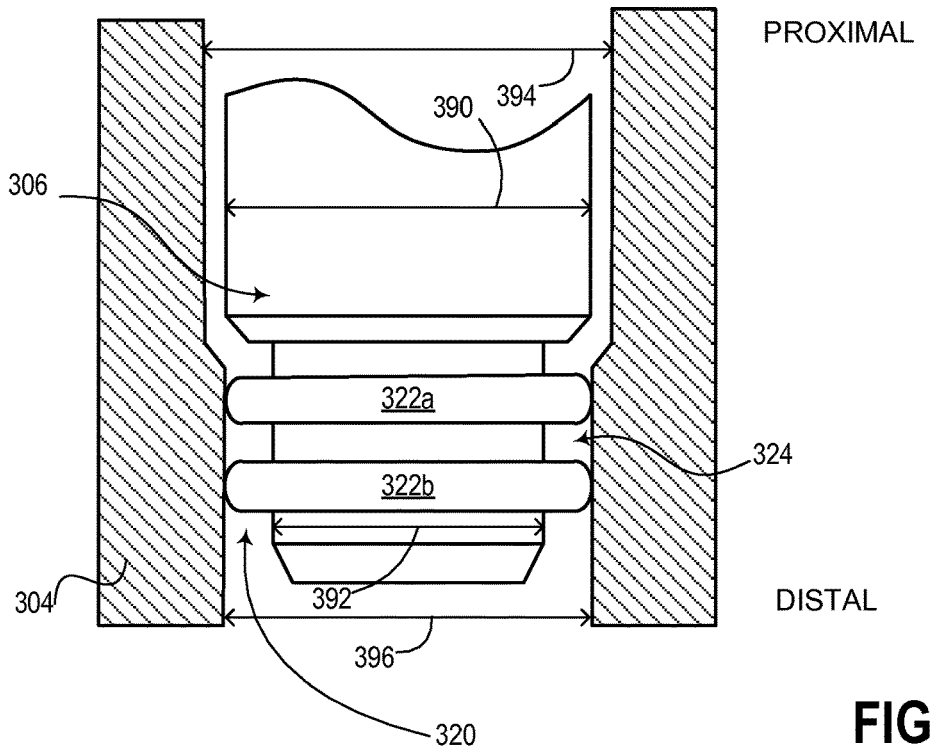
FIG. 3B shows a detailed view of the features of the hydraulic flow restrictor shown at FIG. 3A.
Figure 4:
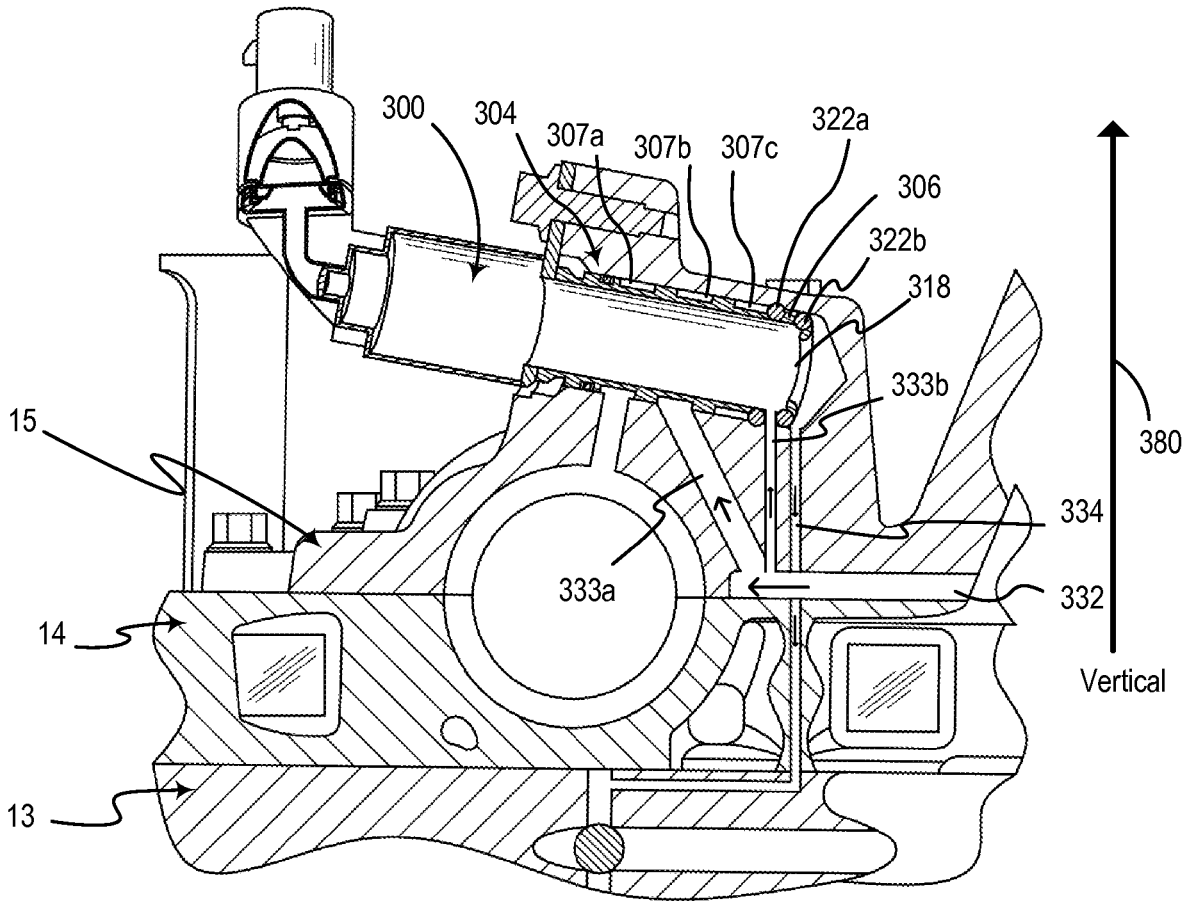
FIG. 4 shows the hydraulic flow restrictor of FIGS. 3A and 3B in the context of a valve deactivation hydraulic circuit that is housed within an engine block.
Figure 5:
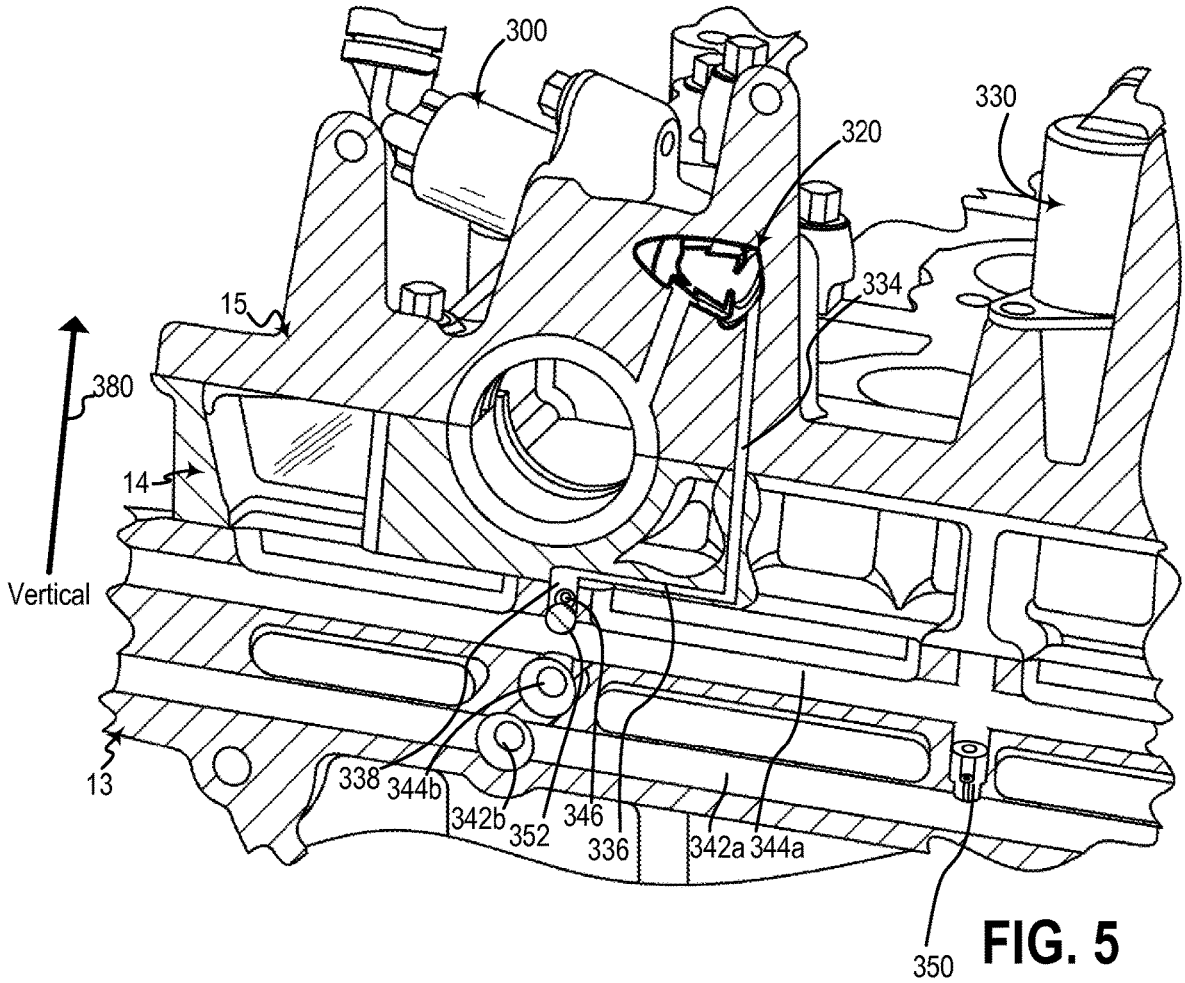
FIG. 5 shows a view of a VCT oil control valve and its fluidic connectivity with other galleries within a valve deactivation hydraulic circuit housed within an engine block.
Figure 6:
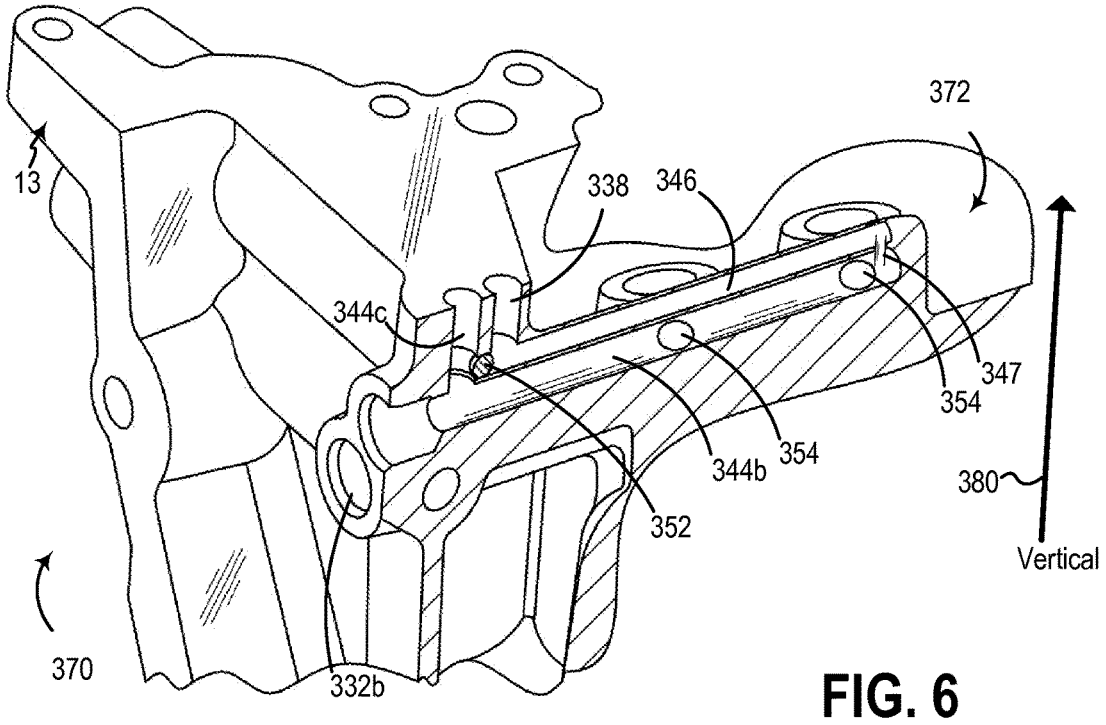
FIG. 6 shows the location of a priming gallery within a cylinder head in relation to hydraulic lash adjusters and first and second HLA galleries.
Figure 7:
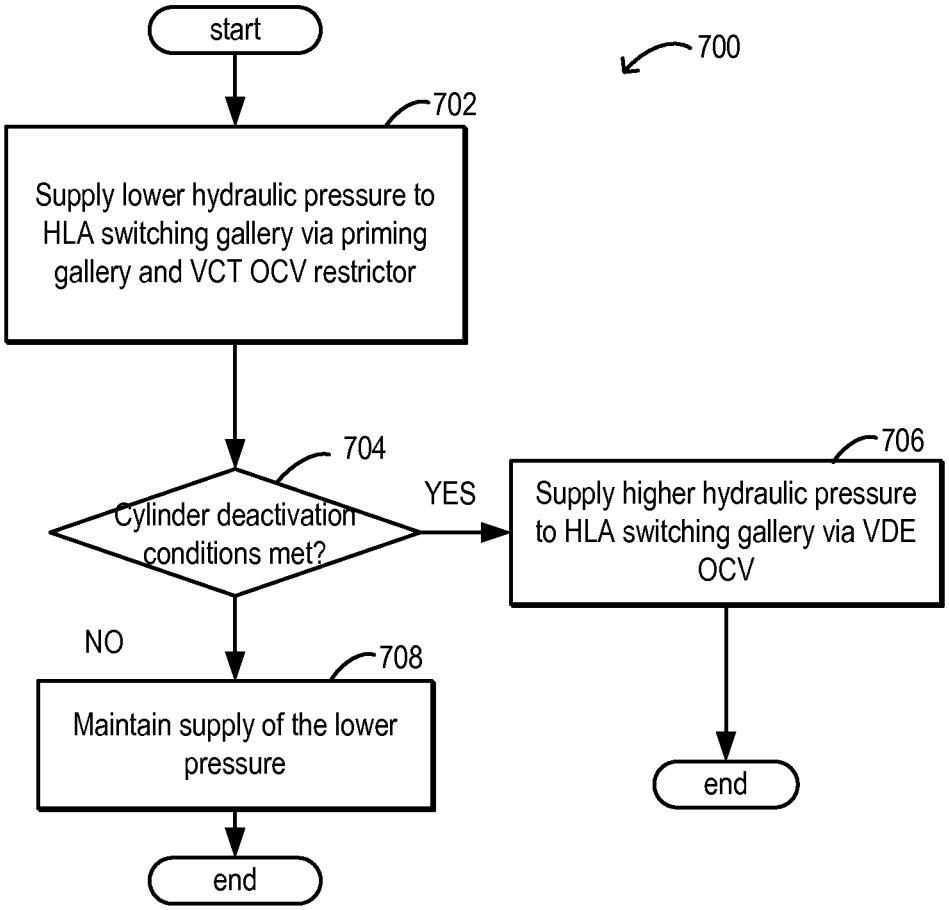
FIG. 7 shows an example method for activating and deactivating a switching roller finger follower integrated into the hydraulic circuit of the present invention.

The following description relates to systems and methods for priming a switching gallery of a valve deactivation hydraulic circuit. FIG. 1 shows a portion of a valve deactivation hydraulic circuit, detailing the fluidic channels of the valve actuating mechanism. FIG. 2A provides a schematic of the present solution to the problem of entrapped air within the valve deactivation hydraulic circuit operating with a de-energized VDE oil control valve. Specifically, a priming gallery is shown in fluidic communication with a switching gallery of the hydraulic circuit, and the priming gallery provides a flow of hydraulic fluid to the switching gallery configured to direct the entrapped air toward a pressure relief valve within the VDE oil control valve. FIG. 2B shows the hydraulic circuit of FIG. 2A with an energized VDE oil control valve. When the VDE oil control valve is energized, a flow of hydraulic fluid at a high pressure travels from the VDE oil control valve toward the valve actuating mechanisms to deactivate the valve actuating mechanism. FIG. 3 shows a hydraulic restrictor incorporated between a VCT oil control valve body and the mating bore of the valve, with FIG. 3A highlighting the structural features of the valve and FIG. 3B highlighting the features of the hydraulic flow restrictor. FIG. 4 shows the position of the VCT oil control valve within the valve deactivation hydraulic circuit. FIGS. 5 and 6 show an example implementation of the hydraulic circuit of FIGS. 2A and 2B within an engine head configuration, providing further details regarding the fluidic connectivity of the components and the methods for constructing the hydraulic circuit within existing hardware such as the cylinder head, cam carrier, and cylinder head cap. FIG. 7 provides an example method for activating and deactivating a switching rolling finger follower that is incorporated within the hydraulic circuit of the present invention.

Referring now to the drawings, and in particular FIG. 1, one embodiment of a valve actuating mechanism 10 of a finger follower type is shown for an internal combustion engine, generally indicated at 12. Engine 12 may include a cylinder head, generally indicated at 13. The view provided at FIG. 1 is a front-end perspective; when engine 12 is installed in an engine compartment of a motor vehicle, the view of FIG. 1 is from the front end of the vehicle looking backward. The front-to-back axis, along the direction of extension of camshafts 34*a, b*, may herein also be referred to as the axial direction. Thus surface 92 is the top surface of the cylinder head, surface 94 is the (cut away) bottom surface of the cylinder head, surface 96 is the left lateral surface of the cylinder head, and surface 98 is the right lateral surface of the cylinder head. As used herein, the lateral direction with respect to engine 12 refers to the axis of the horizontal plane that is aligned with the page, and the axial direction refers to the horizontal axis perpendicular to the lateral direction (i.e., into or out of the page). Put another way, the axial direction refers to the horizontal axis along which a camshaft may be configured to rest within a camshaft carrier (not shown), and the lateral direction refers to the horizontal axis perpendicular to the axial direction.

As shown in the illustrated example, the engine 12 may be of an overhead cam type and cylinder head 13 may include an intake or exhaust port 16. It will be appreciated that in other examples, the present invention may be implemented in engines with cam configurations other than the overhead type. It will be further appreciated that, as illustrated, engine 12 may include a valve actuating mechanism 10 for each of an intake port and an exhaust port of a common cylinder. The valve actuating mechanisms for each intake port of a bank of cylinders may be actuated by a plurality of cams on a first common camshaft 34*a*, and the valve actuating mechanisms for each exhaust port of the bank of cylinders may be actuated by a plurality of cams on a second common camshaft 34*b*. However, in the interest of simplicity, the features of the present invention will be described with reference to only one of these ports. Engine 12 also includes a valve 18 which may comprise a head 19 and a stem 20 extending from the head 19. Engine 12 includes a spring 22 disposed about the stem 20 that may be configured to bias the head 19 of the valve 18 to a closed position. The valve actuating mechanism 10 may also include a finger follower or outer lever, generally indicated at 24, having a pallet or actuating pad 26 engaging the stem 20 of the valve 18. The valve actuating mechanism 10 may further include a roller cam follower 28 having an outer surface 30 engaged by an associated cam 32 of a camshaft 34.

A dual function hydraulic lash adjuster, generally indicated at 36, is supported by the cylinder head 13 and has a rounded end 38. The valve actuating mechanism 10 may include a dome socket, generally indicated at 40, engaging the rounded end 38 of the hydraulic lash adjuster 36. The dome socket 40 may include a dome having a domed outer surface and a generally spherical lower recess or socket for engaging the rounded end of the dual function hydraulic lash adjuster 36. The dome socket 40 may also include an oil feed in the dome that is in fluidic communication with each of the rounded end of the hydraulic lash adjuster 36 and the domed outer surface of the dome socket. In this way, the dome socket 40 may receive hydraulic fluid via the dual function hydraulic lash adjuster 36, and the hydraulic fluid may be delivered to the socket through the oil feed of the dome socket.

It can also be seen that the rounded end 38 is intersected almost directly by a latch pin hydraulic chamber 56 situated in front of a coupling element 5. In this way, the hydraulic fluid (e.g., oil) may be routed from the head of the dual-function hydraulic lash adjuster 38 directly into the latch pin hydraulic chamber 56. Coupling element 5 may be a latch pin that is configured to couple the motion of the inner lever to the outer lever, as described in further detail below. The outer and inner levers may be in either a latched or unlatched state, as controlled by the pressure of hydraulic fluid supplied by HLA 36 to latch pin hydraulic chamber 56.

Continuing still at FIG. 1, a valve actuation mechanism 10 that can be switched to different cam lifts is shown. In the illustrated example, the valve actuation mechanism 10 is an example of a switching roller finger follower and may be referred to as such herein; however, it be appreciated that in alternate examples, any valve actuation mechanism that receives a pressurized hydraulic fluid from a dual-function HLA may be implemented in the present invention. The SRFF may comprise an outer lever that is connected at one end 9 through a crossbar (not shown). An inner lever (not shown) may be situated between arms of the outer lever and may be articulated on the outer lever in the region of a further end 7. The articulation may be realized in that the inner lever is mounted on an axle 33 whose outer axial ends are seated in bores of the arms of the outer lever. The finger lever 24 may include a lost motion spring (not shown), which in one example may be a torsion leg spring that surrounds the axle 33 within the inner lever. In the uncoupled (i.e., unlatched) state of the outer lever from the inner lever, this spring imparts a re-setting motion to the outer lever.

Dual-function hydraulic lash adjuster 36 may receive an amount of hydraulic fluid at a first pressure from HLA gallery 82 at a lash compensation aperture 52. Lash compensation aperture 52 may also be termed a lash compensation port herein. Lash compensation aperture 52 may provide the hydraulic fluid at the first pressure from HLA gallery 82 to a first chamber 53, thereby providing lash compensation functionality to dual-function HLA 36. HLA gallery 82 may provide hydraulic fluid at the first pressure continuously throughout engine operation.

In the coupled state, a spring within the latch pin hydraulic chamber 56 biases coupling element 5 to a position under an entraining surface of the crossbar of the outer lever of the SRFF. In this way, any motion of the inner arm will be transferred to the outer arm via coupling element 5. While the valve actuation mechanism 10 is in the coupled state, switching gallery 84 may provide a lower pressure of hydraulic fluid to dual-function HLA 36 via switching aperture 54. Switching aperture 54 and any analogous ports of a dual-function FHA may herein also be termed a switching port. The lower pressure of hydraulic fluid provided by switching gallery 84 is directed toward a second chamber 55 which may be in fluidic communication with a latch pin hydraulic chamber 56 of an SRFF 10. The lower pressure of hydraulic fluid may provide an amount of priming to the coupling mechanism 5 within the latch pin hydraulic circuit, thereby reducing the transition time between a latched and an unlatched mode of the SRFF. It will be appreciated that first chamber 53 and second chamber 55 may be fluidically isolated, as illustrated at FIG. 1. In other examples, a small amount of fluidic communication may be present between first chamber 53 and second chamber 55.

For decoupling the levers during a base circle phase of the loading cam, the latch pin hydraulic chamber 56 is supplied with a higher pressure of hydraulic fluid from the head of the hydraulic lash adjuster 36. Specifically, as further detailed with reference to FIGS. 2A and 2B, a VDE OCV may be switched from a de-energized state to an energized state to supply a high pressure of hydraulic fluid to a high-pressure switching gallery 84 coupling the IDE OCV to a second aperture 54 of HLA 36. Similarly, the VDE OCV may be switched from an energized state to a de-energized state to discontinue supplying a high pressure of hydraulic fluid to the switching gallery. This high pressure of hydraulic fluid is supplied to the latch pin chamber 56 and may overcome the spring biasing of the coupling element 5, allowing the coupling element 5 to disengage from underneath the entraining surface of the crossbar of the outer lever 24. As a result, the motion of the inner arms, actuated by the loading cam 32, is not transferred to the outer lever 24, and valve 18 is thus not actuated (i.e. it is deactivated).

The valve deactivation hydraulic circuit described above may function unpredictably during conditions in which air is entrapped within one or more of the switching gallery, the HLA 36 and the SRFF 10. For example, the presence of air within the latch pin hydraulic chamber 56 may retard the compression of oil when valve deactivation is desired, thereby increasing the duration between the energizing of the VDE OCV and the unlatching of the inner and outer arms of the SRFF. Thus the presence of air within the valve deactivation hydraulic circuit is undesirable for reducing the transition time between latched and unlatched states of the valve actuation mechanism. One objective of the present invention is to provide a valve deactivation hydraulic circuit which promotes the flow of air out of the HLA galleries, thereby reducing the duration of mode transitions of the valve deactivation mechanism. Such a system is schematically depicted by hydraulic circuit 200 at FIG. 2, and an example implementation is described via FIGS. 3-4. The circuit utilizes an annular clearance between a variable cam timing oil control valve and the mating bore of said valve as a hydraulic flow restrictor, and provides a hydraulic flow at a lower pressure to a priming gallery that runs alongside the high-pressure HLA gallery described above. When the VDE OCV is de-energized, air columns may be purged from the switching gallery as oil, behind the air, flows from the annular clearance of the hydraulic flow restrictor through a priming gallery, through a perpendicular drilling into the switching gallery, and toward a relief valve located within the VDE OCV. In some examples, the air flow may be further promoted toward the relief valve by positioning the priming gallery vertically below the relief valve, thereby utilizing the difference in density between a hydraulic fluid and air. In this way, the priming gallery and the switching gallery may be maintained at a pressure determined by a threshold relief pressure of the pressure relief valve within the VDE OCV. As one example, this threshold relief pressure may be in the range of 0.1 to 0.5 bar.

FIGS. 2A and 2B depict a hydraulic circuit 200, which includes a VDE OCV 210, in two different modes. In FIG. 2A, hydraulic circuit 200 is shown with VDE OCV 210 in a de-energized state, while in FIG. 2B the hydraulic circuit 200 is shown with VDE OCV 210 in an energized state. Hydraulic circuit 200 provides hydraulic pressure to a plurality of valve actuation components, including a first number of switching roller finger followers 232 and a second number of (non-switching) roller finger followers 262 which actuate either intake or exhaust valves of a plurality of cylinders (not shown). In the depicted example, the two SRFFs 232 may selectively actuate two intake or exhaust valves of a first cylinder, and the two pairs of RFFs 262 may actuate two pairs of intake or exhaust valves on each of a second and third cylinder. Thus, as depicted, hydraulic circuit may be for an engine with an 1-3 cylinder configuration, or alternatively may be for one bank of cylinders of a V-6 cylinder arrangement. It will be appreciated, however, that the features of the present invention may be included in engines with alternate valve and cylinder configurations, such as cylinders with only one intake valve and one exhaust valve, and cylinder configurations such as V-4, V-8, I-5, I-4, etc.

FIGS. 2A and 2B share identical components, however at least a portion of the fluidic connectivities between said components may differ between each figure based on whether VDE OCV 210 is energized or de-energized. Further, the directionality of oil flow through several key components, including priming passage 216, perpendicular drilling 217, and switching gallery 214 may be reversed from FIG. 2A to FIG. 2B or vice versa. Thus it will be appreciated that the relative positioning of at least components 214, 216, and 217 (e.g., upstream or downstream from one another) may differ depending on whether VDE OCV 210 is in an energized or de-energized state.

Hydraulic circuit 200 includes a first end 290 and a second end 292. First end 290 and second end 292 provide a relative orientation of components within the circuit. As one example, the plurality of cylinders with valves actuated by hydraulic circuit 200 may be arranged within an engine compartment so that the first end 290 is the front-facing end of the engine compartment, second end 292 is the rear-facing end of the engine compartment. As other examples, first end 290 and second end 292 may respectively be a left side and right side of an engine compartment, or vice versa.

The example hydraulic circuit 200 is shown with a pair of switching roller finger followers 232 and two pairs of (non-switching) roller finger followers 262. A dual-function hydraulic lash adjuster 230 is provided for each SRFF 232, and a (standard) hydraulic lash adjuster 260 is provided for each RFF 262. It will be appreciated while dual-function HLAs 230 and HLAs 260 each respectively provide lash compensation to SRFFs 232 and RFFs 262, dual-function HLAs 230 are additionally in fluidic communication with respective SRFFs 232 for switching the SRFFs 232 between a latched mode and an unlatched mode. Rolling finger followers 262 lack a switching mechanism, and as such, HLAs 260 provide only lash compensation to RFFs 262. It will be appreciated that each dual-function HLA 230 and each HLA 260 includes a lash compensation port 218, and each dual-function HLAs 230 further includes a switching port 220.

Each dual-function HLA 230 may include a channel 231 to provide hydraulic fluid to a latch pin hydraulic chamber of a corresponding SRFF 232. As one example, the channel 231 may comprise a combination of the nose of the hydraulic lash adjuster and a socket of the SRFF configured to accept the HLA nose, as shown at FIG. 1 by dome 38 and dome socket 40, and further described above with reference to FIG. 1. The HLA may provide the latch pin hydraulic chamber (e.g., 56 at FIG. 1) with hydraulic fluid at a first, lower amount of pressure from the switching gallery 214 when the VDE OCV 210 is in a de-energized state, and may provide the latch pin hydraulic chamber with hydraulic fluid at a second, higher amount of pressure via switching gallery 214 when VDE OCV is in an energized state.

In the depicted example, each combustion chamber may include two intake valves. Thus each SRFF 232 may actuate respective poppet valves of a common VDE cylinder (not shown), and the two pairs of RFFs 262 may actuate respective pairs of poppet valves of first and second combustion chambers (not shown). It will be appreciated that a VDE cylinder refers to a combustion chamber that may be activated and deactivated, for example via the respective latching and unlatching of SRFFs 232 that actuate the valves of the VDE cylinder. Thus a VDE cylinder is a deactivatable cylinder. It will be appreciated that while FIG. 2A depicts an engine with a single VDE cylinder per cylinder bank, other example hydraulic circuits may provide hydraulic fluid to SRFFs of a plurality of VDE cylinders of a single cylinder bank.

Referring still to details of hydraulic circuit 200 common to each of FIGS. 2A and 2B, an oil pump 202 is shown providing oil to a VCT oil control valve 208 (via galleries 204, 206*a*, and 206*b*), to VDE OCV 210 via gallery 203, and to dedicated HLA oil supply 298. It will be appreciated that while oil pump 202 is shown as a single pump at FIG. 2, in other examples a more complex hydraulic circuit comprising a plurality of pumps and passages may be configured to supply the aforementioned valves 208, 210 with oil at desired amounts of pressure. It will be further appreciated that oil pump 202 may provide oil to other components of the engine at various pressures, and only components relevant to the present invention are described herein.

Dedicated HLA oil supply 298 may receive oil from oil pump 202. A first hydraulic channel 212, herein also referred to as the HLA gallery, begins at HLA supply 298 and ends at a plurality dual-function HLAs 230 and HLAs 260. Thus, HLA gallery 212 is downstream of HLA supply 298 and upstream of a plurality of dual-function HLAs 230 and HLAs 260. Specifically, HLA gallery 212 provides oil to a lash compensation port 218 of each dual-function HLA 230 and each HLA 260. Thus HLA gallery 212 provides oil to each HLA 260 and each dual-function HLA 230 at a lower amount of pressure for lash compensation function. In one example, the lower amount of hydraulic pressure within HLA gallery 212 may be within a range of 0.5 bar to 2 bar. It will be appreciated that HLA gallery 212 supplies oil to each lash compensation port 218 whether or not VDE OCV 210 is energized. HLA supply 298 may include one or more of a restrictor and an oil pump and may be configured to receive oil from the oil pump and deliver the oil to HLA gallery 212.

The VCT OCV 208 may receive oil from a first oil supply gallery 206*a* and a second oil supply gallery 206*b*. In the illustrated example, each oil supply gallery is provided oil from a high pressure VCT supply 204 and each gallery enters the oil control valve 208 at two locations via a branching of the supply line. However, in other embodiments, a low-pressure restricted cylinder head oil supply (not shown) may be configured to provide oil to the second oil supply gallery 206*b* of the VCT OCV, and high pressure VCT supply 204 may be further configured as oil supply gallery 206*a*. As an example, the hydraulic pressure of the oil received at each oil supply galleries 206*a* and 206*b* may within the range of 2 to 4 bar. The VCT OCV may be a spool valve including a plurality of spool lands, and may be housed within a tight-fitting mating bore within a cylinder head cap, as further described with reference to FIGS. 3A-B. As one example, oil supply gallery 206*a* may feed oil directly into the supply port of the valve, and oil supply gallery 206*b* may provide oil to an annular clearance outside of the VCT OCV, between the valve body and the mating bore of the valve. This annular clearance may function as a hydraulic flow restrictor and, when the VDE OCV 210 is de-energized, may provide oil to priming gallery 216 at a restricted hydraulic pressure, as described in further detail below. In particular, the first oil supply gallery 206*a* may provide oil to VCT OCV supply port that directs oil to a camshaft head for adjusting cam timing components. VCT OCV 208 includes an oil return gallery 209 for delivering waste to the oil sump 240 upon changing position. Oil sump 240 may deliver oil to the oil pump 202 via line 242.

VDE OCV 210 may be a solenoid valve that is configured to selectively provide a high oil pressure to high-pressure port 220 of each dual function hydraulic lash adjuster 230. It will be appreciated that high-pressure ports 220 are herein also termed switching ports. A second hydraulic channel 214, also termed the switching gallery, begins at VDE OCV 210 and ends at a plurality of switching ports 220. Switching gallery 214 and may provide a first, lower amount of pressure to the switching port 220 of each dual-function HLA when the VDE OCV is in a de-energized state, and may provide a second, higher amount of pressure to the switching port 220 each dual-function HLA 230 when the VDE OCV is in an energized state. FIG. 2A shows VDE OCV 210 in a de-energized state, as indicated by the disconnected switch 213. In the de-energized state, switching gallery 214 is provided the first, lower amount of pressure via a hydraulic flow restrictor within VCT OCV 208, priming gallery 216, and perpendicular drilling 217, as described in further detail below with reference to FIG. 2A. In the energized state, switching gallery 214 is provided with the second, higher amount of pressure via the VDE OCV switch 213, as described in further detail with reference to FIG. 2B.

In the illustrated example, VDE OCV 210 is shown in fluidic communication with two SRFFs 232 of a single VDE cylinder. However, it will be appreciated that in other examples, VDE OCV may be in fluidic communication with the SRFFs of a plurality of VDE cylinders of a common cylinder bank, and each VDE cylinder may include similar valve deactivation circuitry. In one example, a dedicated priming gallery 216 may be provided for each of a plurality of VDE cylinders, however in other examples a single priming gallery 216 may be provided for the plurality of VDE cylinders. It will be appreciated that a single VDE OCV 210 is provided for each VDE cylinder of the engine, however examples including a number of VDE cylinders may include the same number of VDE OCVs. Other example hydraulic circuits contemplated herein may include a plurality of VDE cylinders and a single VDE OCV in fluidic communication with the plurality of VDE cylinders. The single VDE OCV may be configured to activate and deactivate each VDE cylinder separately, or may be configured to activate and deactivate the plurality of VDE cylinders in one or more groups of cylinders.

VDE OCV may include a pressure relief valve 244 which may be configured to release air and oil to oil sump 240 when VDE OCV 210 is de-energized, and may be sealed from releasing any fluids to oil sump 240 when VDE OCV 210 is energized. As one example, the pressure relief valve may be configured to release pressure at a threshold pressure greater than the pressure supplied to the switching gallery when the VDE OCV is in a de-energized state.

In some examples, a hydraulic restrictor (not shown) may couple the HLA gallery 212 and the switching gallery 214 upstream of the hydraulic lash adjuster, and may allow a low amount of pressure from the HLA gallery 212 to flow through to the switching gallery 214 when VDE OCV is de-energized. In this example, when the VDE OCV is energized, the hydraulic flow restrictor may allow a portion of the high hydraulic pressure of the switching gallery 214 to flow to the HLA gallery 212. However, in other examples, VDE OCV 210 may be configured to provide the second hydraulic channel 214 with a lower amount of hydraulic pressure when the valve is in a de-energized state, and may be configured to provide the second hydraulic channel with a higher amount of hydraulic pressure when the valve is in an energized state.

Turning now to FIG. 2A, an example hydraulic circuit 200 for valve deactivation, including VDE OCV 210, is shown operating in a first mode. Specifically, FIG. 2A depicts hydraulic circuit 200 with VDE OCV 210 operating in a de-energized state so that switching roller finger followers 232 are in a latched mode, thereby actuating respective poppet valves (not shown). It will be appreciated that when VDE OCV 210 is in a de-energized state, switch 213 is switched off and VDE OCV 210 is not configured to provide a high hydraulic pressure to switching gallery 214. In this example, the hydraulic fluid may be oil, and any references herein to oil pressure are non-limiting examples of a hydraulic pressure.

When VDE OCV 210 is in a de-energized state, an annular hydraulic flow restrictor incorporated between the outer body of VCT OCV 208 and the mating bore of VCT OCV 208 supplies a restricted amount of hydraulic pressure to priming gallery 216 via oil supply port 206*b*. As one example, the pressure of hydraulic fluid entering oil supply port 206*b* may be in the range of 2 to 4 bar, while the pressure of restricted hydraulic fluid supplied to priming gallery 216 may be in the range of 0.1 to 0.5 bar.

Priming gallery 216 may be coupled to and upstream of switching gallery 214 via perpendicular drilling 217, and may supply switching gallery 214 with a first, lower hydraulic pressure. It will be appreciated that the flow of hydraulic fluid from priming gallery 216 toward switching gallery 214 may be promoted via the pressure differential across the hydraulic flow restrictor that is incorporated within an annular clearance of the body of VCT OCV 208. As an example, the first lower hydraulic pressure supplied to switching galley 214 may be the restricted hydraulic fluid pressure supplied to the priming gallery 216 via the annular hydraulic restrictor of the VCT OCV 208. It will be further appreciated that the fluidic coupling of priming gallery 216 to switching gallery 214 maintains each gallery 214, 216 at a common hydraulic pressure.

Switching gallery 214 may be fluidically coupled to each dual-function HLA 230 via switching ports 218 included with each dual-function HLA 230. Thus, because the switching chambers of each dual-function HLA 230 is in fluidic communication with a respective SRFF 232, each SRFF 232 may also be in fluidic communication with switching gallery 214. Switching gallery 214 is also fluidically coupled to and upstream of a pressure relief valve 244 located within VDE OCV 210. Pressure relief valve 244 may be configured to release pressure into oil sump 240 via line 211 when VDE OCV 210 is de-energized and pressure within switching gallery 214 is above a threshold pressure. The threshold pressure may be based on pressure relief valve characteristics. Thus, in the example where the threshold pressure is the first, lower hydraulic pressure supplied to switching gallery 214 via priming gallery 216, pressure relief valve 244 may maintain switching gallery 244 at the first, lower hydraulic pressure.

In some examples, when VDE OCV 210 is de-energized, pockets of air may be present within switching gallery 214, one or more dual-function HLA 230, one or more SRFFs 232, and/or a combination thereof. By promoting a restricted flow of hydraulic fluid from priming gallery 216, through switching gallery 214, and toward pressure relief valve 244, pockets of air within switching gallery 214, dual-function HLAs 230, or SRFFs 232 may be captured along with the restricted hydraulic flow and released to oil sump 240 via pressure relief valve 244. Thus, by providing a restricted hydraulic flow to switching gallery 214 via an annular restrictor and priming gallery 216, air may be purged from the hydraulic channels and chambers of a number of valve deactivation components when VDE OCV 210 is de-energized. In this way, hydraulic response times may be improved upon switching VDE OCV from a de-energized state to an energized state.

As indicated by the arrows along the hydraulic channels at FIG. 2A, the flow of hydraulic fluid is unidirectional: hydraulic fluid is not configured to flow from a dual-function HLA 230 upstream to the VDE OCV 210, and instead any excess fluid may be drained to oil sump 240 via clearances (not shown for the clarity of other features contemplated herein). It will be understood that each dual-function HLA 230 is identical and the first and second HLA ports 218, 220 are the same corresponding ports of each dual-function HLA. It will be appreciated that hydraulic fluid does not refer to air. It will be further appreciated that while the flow of air is not indicated in FIG. 2A, air may flow from an SRFF 232 toward a dual-function HLA 230, and from a dual-function HLA 230 toward a pressure relief valve 244 via switching gallery 214.

Thus in the de-energized state of VDE OCV 210, hydraulic circuit 200 may include a VCT OCV 208 is upstream of a priming gallery passage 216, a priming gallery upstream of a switching gallery 214 and fluidically coupled to a switching gallery 214 via a perpendicular drilling 217, and a switching gallery 214 upstream of a pressure relief valve 244 located within a VDE OCV 210. The flow of hydraulic fluid through priming gallery 216 may be controlled by a pressure differential across an annular hydraulic flow restrictor located upstream of priming gallery 216, and the pressure of hydraulic fluid within priming gallery 216 may be controlled by a pressure relief valve 244 located downstream of each of priming gallery 216, perpendicular drilling 217, and switching gallery 214.

When VDE OCV 210 is in a de-energized state, the flow of hydraulic fluid through priming gallery 216 begins at a VCT OCV 208 and ends at a VDE OCV 210. It will be appreciated that in this de-energized state, with regard to the flow of fluid through switching gallery 214, the VDE OCV is downstream of the valve deactivation components. Similarly, with regard to the flow of fluid through priming gallery 216, the VDE OCV is downstream of the valve deactivation components. It will be further appreciated that the flow of hydraulic fluid through the priming gallery 216 is from a first end 290 of the hydraulic circuit toward a second end 292 of the hydraulic circuit, while the flow of hydraulic fluid through the switching gallery 214 is in the opposite direction: from the second end 292 toward the first end 290.

In some examples, hydraulic circuit 200 may include a plurality of perpendicular drillings 217 and may couple priming gallery 216 to switching gallery 214 at a number of locations within switching gallery 214 that are immediately upstream of the same number of dual-function HLAs 230. In this way, by providing a restricted hydraulic flow in front of each hydraulic lash adjuster, the flow of any air entrapped within any HLA 230 or SRFF 232 toward pressure relief valve 244 may be increased. In this way, oil compression response times may be improved when VDE OCV 210 is switched form a de-energized state to an energized state.

Turning now to FIG. 2B, it shows hydraulic circuit 200 with VDE OCV 210 in an energized state. When VDE OCV 210 is in an energized state, switch 213 is closed and VDE OCV 210 may provide a second amount of hydraulic pressure to switching gallery 214. As one example, the second amount of hydraulic pressure may be within a range of 2 to 4 bar. It will be appreciated that the second amount of hydraulic pressure is higher than the first amount of pressure provided to switching gallery via the restricted flow from priming gallery 216 during de-energized VDE OCV conditions. Further, when VDE OCV 210 is in an energized state, pressure relief valve 244 is closed and does not release any pressure to oil sump 240. Thus line 213 of FIG. 2A is omitted at FIG. 2B, and hydraulic fluid is configured to flow away from VDE OCV 210 in the energized state, rather than toward VDE OCV 210 as in the de-energized state.

The oil at the second amount of hydraulic pressure may flow from VDE OCV 210 toward switching gallery 214, and may be provided to switching ports 220 of each dual-function HLA 230. In this way, when VDE OCV 210 is in an energized state, each dual-function HLA 230 may be configured to provide a respective SRFF 232 with a second, higher amount of pressure to maintain the SRFF 232 in an unlatched mode. Thus the energized state of VDE OCV 210 corresponds to a deactivated state of a VDE cylinder.

The flow of hydraulic fluid at FIG. 2B is such that VDE OCV 210 is upstream of each of switching gallery 214 and valve deactivation components 230, 232. Switching gallery 214 is upstream of priming gallery 216, and switching gallery 214 is coupled to priming gallery 216 via perpendicular drilling 217. Thus, when VDE OCV 210 is in an energized state, the pressure within priming gallery 216 may also be at the second, higher pressure (e.g., between 2 and 4 bar).

Priming gallery 216 is upstream of and directly coupled to an annular hydraulic flow restrictor incorporated into the valve body of VCT OCV 208. The annular restrictor of the VCT OCV 208 is provided an amount of hydraulic pressure from oil supply 206*b*, and this hydraulic pressure may be substantially similar to the second, higher pressure provided to priming gallery 216 via VDE OCV 210. In this way, when VDE OCV 210 is in an energized state, flow from priming passage 216 through the annular restrictor of VCT OCV 208 and to oil supply 206*b* may be reduced by the balanced pressures on each side of the annular restrictor of VCT OCV 208.

The hydraulic circuit 200 of FIG. 2B thus includes a flow of hydraulic fluid beginning at a VDE OCV, flowing downstream through a switching gallery 214 and further downstream into a plurality of dual-function HLAs 230 and SRFFs 232. The hydraulic circuit 200 of FIG. 2B further includes hydraulic fluid beginning at a VDE OCV, flowing downstream through a switching gallery 214, and further downstream into a priming gallery 216 via a perpendicular drilling 217 that couples the switching gallery to the priming gallery toward a second end 292 of the hydraulic circuit. Some hydraulic fluid may flow from the first end 290 of the priming gallery 216 across an annular hydraulic flow restrictor incorporated into the valve body of a VCT OCV 218.

When VDE OCV 210 is in a de-energized state, the flow of hydraulic fluid through priming gallery 216 begins at a VCT OCV 208 and ends at a VDE OCV 210. It will be appreciated that in this de-energized state, with regard to the flow of fluid through switching gallery 214, the VDE OCV is downstream of the valve deactivation components. Similarly, with regard to the flow of fluid through priming gallery 216, the VDE OCV is downstream of the valve deactivation components. It will be further appreciated that the flow of hydraulic fluid through the priming gallery 216 is from a first end 290 of the hydraulic circuit toward a second end 292 of the hydraulic circuit, while the flow of hydraulic fluid through the switching gallery 214 is in the opposite direction: from the second end 292 toward the first end 290.

Thus, in a first state of operation, hydraulic circuit 200 may passively control the pressure of hydraulic fluid within each of the switching gallery 214 and the priming gallery 216 at a first, lower pressure via an annular hydraulic flow restrictor incorporated into the outer body of VCT OCV 208 and an open pressure relief valve within a VDE OCV. In a second state of operation, hydraulic circuit 200 may actively control the pressure of hydraulic fluid within each of the switching gallery 214 and the priming gallery 216 at a second, higher pressure via each of an energized VDE OCV including a closed pressure relief valve and a balancing of pressures across the annular hydraulic flow restrictor.

Turning now to FIG. 3A, it shows a cross-sectional view of VCT OCV 300, including a hydraulic flow restrictor (indicated generally at 320) incorporated at the axially distal end of the valve for providing a restricted hydraulic flow to the priming gallery of the valve deactivation hydraulic circuit. Details regarding the fluidic communication of VCT OCV 300 with the remainder of the valve deactivation hydraulic circuit are generally omitted with reference in FIG. 3A, and are instead described with reference to FIGS. 4 and 5. The hydraulic flow restrictor 320 may comprise an annular clearance between the valve body outer diameter and the inner surface of the mating bore 304, as described in further detail with reference to FIG. 3B. A separate VCT OCV may be provided for each of the camshafts actuating the intake and exhaust ports of a cylinder bank. Each VCT OCV may be positioned within the cylinder head cap 15 that is positioned adjacent to and immediately above camshaft carrier 14. Each valve actuation mechanism is actuated by a cam on a camshaft positioned between camshaft carrier 14 and cylinder head cap 15, and is thus in close proximity to the VCT OCV. By incorporating the hydraulic flow restrictor into the VCT OCV and in close proximity to the valve actuation mechanisms, the amount of drilling, casting, etc. required to construct the valve deactivation hydraulic circuit of the present invention may be reduced. Further, by reducing the amount of drilling between the priming gallery receiving the restricted flow and the switching gallery, the amount of air within the switching gallery may be reduced while maintaining desired amounts of hydraulic volume and hydraulic flow within the switching gallery. In this way, each of the priming gallery and switching gallery may be quickly filled with a high-pressure hydraulic flow upon energizing a VDE OCV.

As used herein, and with reference to the present illustration, the axially proximal end of the VCT OCV 300 refers to the axial end of the valve that is adjacent to the support arm 302, and a feature of the valve is said to be located axially proximal from a second feature if the first feature is closer to support arm 302. As one example, support arm 302 may house an electrical bus that is in electronic communicating with a wire harness (not pictured) for controlling the VCT OCV. Similarly, the axially distal end of the VCT OCV 300 refers to the axial end deepest within the mating bore 304, and a first feature of the valve is said to be located axially distal from a second feature if the first feature is closer to the distal end of the valve.

VCT OCV 300 is shown housed within mating bore 304, which may comprise a machined bore within a cylinder head cap 15. VCT OCV 300 may comprise a plurality of spools (not shown) configured to direct the flow of oil from inlet flow ports to outlet flow ports. The plurality of spools may have varying axial and radial extents. In the illustrated example, the valve includes work ports 307*a-c* for controlling various aspects of cam timing. As an example, work port 307*a* may be an advance timing port, work port 307*b* may be the valve supply port, and work port 307*c* may be a retard port. Hydraulic flow may enter work port 307*b* and be directed toward either work port 307*a* or work port 307*c* by a spool valve (not shown) located within the valve body. VCT OCV 300 further includes a valve nose 306 at the distal end of the valve body. Valve nose 306 may begin at the axially distal end of work port 307*c* and may compose the distal end of the valve body.

Turning now to FIG. 3B, it shows a closer, cross-sectional and cutaway view of valve nose 306 housed within mating bore 304. In some examples, valve nose 306 may have a first, larger outer diameter 390 along a proximal portion of its axial extent, and a second, smaller outer diameter 392 along a distal portion of its axial extent. Correspondingly, mating bore 304 may be machined to taper at its deepest extent to accommodate the reduced VCT valve body outer diameter. Specifically, mating bore 304 may be machined to have a first, lager bore diameter 394 along a proximal portion of its axial extent, and a second, smaller bore diameter along a distal portion of its axial extent. As one example, the first outer diameter 390 may be chosen to provide roughly a 10 micrometer radial clearance between the valve body and the first, larger bore diameter 394, and the second outer diameter may be chosen to provide roughly a 75 micrometer clearance between the valve body and the second, smaller bore diameter 396. In this way, the a distal portion of valve nose 306 may be tightly housed within the second diameter 396 of mating bore 304 while the proximal remainder may be tightly housed within the first diameter 394 of the mating bore. As will be explained with further detail below, this may provide a tight fit of o-rings positioned circumferentially around valve nose 306.

FIG. 3B also shows the annular hydraulic flow restrictor, generally indicated at 320. Hydraulic flow restrictor may comprise two o-rings 322*a,b* snugly fit circumferentially around valve nose 306 at its second outer diameter 392. It will be appreciated that in examples where valve nose 306 comprises only a single outer diameter, each o-ring 322*a,b* is fit circumferentially around its single outer diameter. O-rings 322*a,b* may be identical and may be placed at axially opposing ends of a single diameter of valve nose 306. As one example, the o-rings may be manufactured from rubber. Referring to the radial axis of valve nose 306, the o-rings 322*a,b* may extend radially from an outer diameter of the valve to a corresponding mating bore diameter. Put another way, each of o-rings 322*a* and 322*b* may span the entire radial extent of the annular clearance. In one example, the radial extent of the annular clearance may be within a range of 50-80 micrometers, while the axial extent of the annular clearance (e.g., excluding the axial extent of the o-rings) may be within a range of 3-4 millimeters. Because the VCT oil control valve is a component that is necessarily manufactured with tight tolerances, the tight tolerances desired for a reliable hydraulic flow restrictor may be achieved during the machining of the VCT OCV, thus reducing manufacturing costs associated with machining a separate restrictor component. As an example, machining a separate restrictor component that achieves similar flow restriction characteristics as the annular clearance described herein may include machining small cross sectional areas at great axial lengths (e.g., cross-sectional diameters between 0.4-0.5 mm, and axial lengths ranging between 5-10 mm in length). Further, in examples wherein oil supplied to the VCT OCV is filtered, costs and packing constraints associated with additional filters for the hydraulic flow restrictor feed may be reduced. The positioning of o-ring 322*a* at an axially proximal end of valve nose 306 may reduce the influence of hydraulic pressure within work ports 307*a-c* on the hydraulic pressure within annular clearance 324. Similarly, positioning o-ring 322*b* at an axially distal end of the annular clearance 324 may reduce communication between annular clearance 324 and the VCT OCV drain (318 at FIG. 3A). In a preferred embodiment, the reduction of hydraulic communications provided by the positioning of each o-ring 322*a,b* may entirely isolate the hydraulic pressure within the annular clearance from the VCT system and the drain, respectively. By locating the hydraulic flow restrictor 320 within the cylinder head, the reliability of hydraulic sealing may be improved as compared to a restrictor implementation that is external to the engine block.

Turning now to FIG. 4, VCT OCV 300 is shown in the context of a plurality of hydraulic galleries associated with a valve deactivation hydraulic circuit as contemplated in the present invention. The hydraulic circuitry housing comprises a plurality of bores and grooves in each of cylinder head 13, camshaft carrier 14, and cylinder head cap 15. When assembled to operate in the engine compartment of a vehicle that is on flat ground, camshaft carrier 14 is positioned vertically above cylinder head 13, and cylinder head cap 15 is positioned vertically above camshaft carrier 14. Vertical 380 is provided to indicate the direction perpendicular to flat ground when the engine block is installed in an engine compartment of a vehicle on flat ground, and further it provides a relational orientation between FIGS. 3-6. Any axis extending along the plane perpendicular to vertical 380 will be understood to be a horizontal direction. Additionally, flow arrows are provided within a number of hydraulic galleries to indicate the directionality of hydraulic flow within each gallery.

VCT OCV 300 may generally receive hydraulic fluid from VCT supply gallery 332, which may branch into hydraulic fluid supplies 333*a* and 333*b* coupled to separate valve inlets as illustrated. Supply gallery 332 may be constructed from a first cast groove in the bottom horizontal surface of cylinder head cap 15 and a second cast groove in the top horizontal surface of camshaft carrier 14, the first cast groove flushly aligned with the second cast groove along the horizontal interface between the cylinder head cap and the camshaft carrier. Thus supply gallery 332 extends horizontally along the lateral plane of the engine head.

Supply line 333*a* may provide hydraulic fluid directly to work port 307*b* for controlling various components related to cam timing, while supply line 333*b* may supply a "VDE section" of the VCT OCV via the annular clearance 324. It will be understood that each valve inlet may be hydraulically isolated by one or more o-rings as described above. Line 333*b* may be a branch from channel 332, directly coupling supply gallery 332 to the inlet of the hydraulic flow restrictor 320 within the mating bore of VCT OCV 300. As illustrated, line 333*b* may extend in the vertical direction, and may be a bore within cylinder head cap 15. The VCT OCV may be configured to drain excess hydraulic fluid from the advance and retard ports 307*a,c* via drain port 318. It will be noted that the channel coupling drain port 318 to the oil sump is not shown, and is instead obscured in FIGS. 3A-B by cylinder head cap 15. It will be further noted that drain port 318 is not directly coupled to hydraulic channel 334.

Line 333*b* may supply hydraulic fluid to the hydraulic flow restrictor 320 at a pressure P1, for example 2 to 4 bar. Line 333*b* may be a branch from a dedicated VCT oil supply (e.g., branching from line 332 as shown), directly coupling the dedicated supply gallery to the inlet of the hydraulic flow restrictor. Alternatively, line 333*a* may originate from a restricted cylinder head hydraulic fluid supply, in which case line 333*a* may directly couple the cylinder head restrictor to the hydraulic flow restrictor 320 within the mating bore 304 of VCT OCV 300.

Hydraulic fluid may be received by the annular clearance 324 between o-rings 322*a,b* at a first pressure P1, and may be restricted to a second outlet pressure P2, where P2 is less than P1. Hydraulic flow restrictor 320 may be configured to direct the hydraulic fluid of pressure P2 toward hydraulic line 334. Thus hydraulic fluid may exit the hydraulic flow restrictor via line 334 at a pressure P2 less than P1, for example a P2 may be between 0.1 to 0.5 bar. Line 334 may directly couple the outlet of the hydraulic flow restrictor 320 to a hydraulic channel located within the cylinder head 13, as discussed below. In this way, a precisely restricted amount of hydraulic flow and a regulated pressure may be supplied to the priming gallery of a valve deactivation hydraulic circuit by a hydraulic flow restrictor incorporated into the distal end of a VCT oil control valve.

Turning now to FIG. 5, it provides further detail of the hydraulic connectivity of VCT OCV 300 to the rest of the valve deactivation circuit. The hydraulic circuitry housing comprises a plurality of bores and grooves in each of cylinder head 13, camshaft carrier 14, and cylinder head cap 15. Components 13-15 may herein be referred to as engine block components. When assembled to operate in the engine compartment of a vehicle that is on flat ground, camshaft carrier 14 is positioned vertically above cylinder head 13, and cylinder head cap 15 is positioned vertically above camshaft carrier 14. Vertical 380 is provided to indicate the direction perpendicular to flat ground when the engine block is installed in an engine compartment of a vehicle on flat ground, and further it provides a relational orientation between FIGS. 3-6. Any axis extending along the plane perpendicular to vertical 380 will be understood to be a horizontal direction.

With reference to the engine block, a lateral cross section is shown at FIG. 5. As used herein, the lateral direction with respect to engine block components 13-15 refers to the axis within the horizontal plane that is aligned with the page, and the axial direction refers to the horizontal axis perpendicular to the lateral direction (i.e., into or out of the page). Put another way, the axial direction refers to the horizontal axis along which a camshaft may be configured to rest within camshaft carrier 14 (as evidenced by the cylindrical cutout below the VCT OCV), and the lateral direction refers to the horizontal axis perpendicular to the axial direction.

Cylinder head 13 includes an HLA gallery 342 comprising a lateral portion 342*a* and an axial portion 342*b*. In one example, HLA gallery 342 may be provided hydraulic fluid from a dedicated HLA supply (not shown). HLA gallery 342 may be configured to provide a plurality of hydraulic lash adjusters (not shown) with hydraulic fluid at a first, lower pressure whenever the engine is running HLA gallery 342 may be a bore within cylinder head 13.

In some examples, a hydraulic flow restrictor 350 may be included within a hydraulic passage of the cylinder head, and may restrict fluidic communication between HLA gallery 342 and switching gallery 344, which similarly comprises a lateral portion 344*a* and an axial portion 344*b*, and which may be bored into a cylinder head. Specifically, hydraulic flow restrictor 350 may allow a restricted amount of hydraulic fluid to flow from HLA gallery 342*a* to switching gallery 344*a* when the hydraulic pressure within the switching gallery 344 is below a threshold amount (e.g., when VDE OCV 330 is in a de-energized state, as described with reference to FIG. 2). Similarly, hydraulic flow restrictor 350 may allow a restricted amount of hydraulic fluid to flow from switching gallery 344*a* to HLA gallery 342*a* when the hydraulic pressure within switching gallery 344*a* is above a threshold amount (e.g., when VDE OCV 330 is in an energized state). As one example, the threshold pressure within the switching gallery may be the pressure at which the HLA gallery 342*a* is maintained by a dedicated HLA supply (e.g., HLA supply 298 at FIG. 2). In such an example, a restricted amount of fluid may be allowed to flow from the HLA gallery to the switching gallery when the hydraulic fluid within the HLA gallery is at a greater pressure than the hydraulic fluid within switching gallery, and may be disallowed from flowing when the HLA gallery pressure is less than the switching gallery pressure. It will be appreciated that hydraulic fluid will not flow from switching gallery 344*a* to HLA gallery 342*a* when the hydraulic pressure within switching gallery 344*a* is below a threshold amount.

VDE OCV 330 may be coupled to switching gallery 344 (point of coupling not shown), and may be configured to selectively provide switching gallery 344 with hydraulic fluid at a high hydraulic pressure (e.g., 2 to 4 bar). VDE OCV 330 may be switched between a de-energized state and an energized state. The VDE OCV may be configured to provide hydraulic fluid to switching gallery 344 at a higher hydraulic pressure when in the energized state, and may be configured to maintain a lower amount of hydraulic pressure when in the de-energized state. As described above with reference to FIG. 2, the hydraulic fluid at a high hydraulic pressure supplied by VDE OCV 330 may flow downstream toward a valve actuation mechanism and may allow for the deactivation of the mechanism when the VDE OCV is in the energized state. As one example, the lower amount of hydraulic pressure within switching gallery 344 may be maintained via a pressure relief valve (not shown) within VDE OCV that is coupled to switching gallery 344 and that is configured to release pressure above the lower amount of hydraulic pressure. As shown at FIG. 5, by positioning VDE OCV 330 (and therefore the pressure relief valve) vertically above each of the priming and switching galleries, air may be further promoted to flow toward the pressure relief valve due to its low density as compared to hydraulic fluids. As described above with reference to FIG. 2, when VDE OCV 330 is in a de-energized state, the flow of hydraulic fluid within switching gallery 344 may be originate from a priming gallery (not shown), and the pressure of this flow may be maintained by the pressure relief valve within VDE OCV 330, located downstream of the priming gallery with regard to the flow of the hydraulic fluid.

Turning now to other elements of the valve deactivation hydraulic circuit shown at FIG. 5, line 334 is shown receiving a restricted amount of hydraulic fluid from annular hydraulic flow restrictor 320, as described above with reference to FIG. 4. Line 334 may extend in the vertical direction, and in some examples may comprise a top portion and a bottom portion. In one example, the top portion may be a vertical drilling within cylinder head cap 15, the bottom portion may be a vertical drilling within camshaft carrier 14, and the top portion may be flushly aligned with the bottom portion at the horizontal interface between the cylinder head and the camshaft carrier, thereby forming a single hydraulic channel. Line 334 may be one of a number of intermediate hydraulic channels coupling the hydraulic flow restrictor 320 to the priming gallery 346, an axial cross-section of which is shown at the present figure. It will be noted that line 334 does not intersect hydraulic channel 332, although it may be in indirect fluidic communication with hydraulic channel 332. Namely line 334 may be located downstream of channel 332 by way of line 333*b* and hydraulic flow restrictor 320 when the VDE is in a de-energized state.

Line 336 is downstream from line 334, may be configured to receive oil directly from line 334, and may couple line 334 to line 338. Line 336 may be constructed via a casting along the horizontal interface of camshaft carrier 14 and the cylinder head 13. Line 334 may intersect line 336 from above, and line 336 may extend horizontally along the lateral face of the cylinder head, carrying any hydraulic fluid from line 334 toward the priming gallery 346.

Hydraulic line 338 may be a vertical drilling into the cylinder head 13, and may be sealed from the atmosphere by the bottom horizontal face the camshaft carrier 14. The connectivity of hydraulic line 338 will be discussed in further detail below, with reference to FIG. 5. Ball plug 352 is shown providing a hydraulic separation between switching gallery 344 and priming gallery 346, and will be described in further detail with reference to FIG. 6.

Turning now to FIG. 6, it provides a cross-sectional view of cylinder head 13 in the vicinity of the priming gallery and the axial portion of the switching gallery. As described above with reference to each of FIGS. 4 and 5, the hydraulic circuitry housing comprises a plurality of bores and grooves in each of cylinder head 13, camshaft carrier 14, and cylinder head cap 15.

When assembled to operate in the engine compartment of a vehicle that is on flat ground, camshaft carrier 14 is positioned vertically above cylinder head 13, and cylinder head cap 15 is positioned vertically above camshaft carrier 14. Vertical 380 is provided to indicate the direction perpendicular to flat ground when the engine block is installed in an engine compartment of a vehicle on flat ground, and further it provides a relational orientation between FIGS. 3-6. Any axis extending along the plane perpendicular to vertical 380 will be understood to be a horizontal direction. First end 370 and second end 372 are indicated provide relative ends or positioning of any components mentioned herein, and are analogous to first end 290 and second end 292 at FIG. 2.

Priming gallery 346 may be formed from an axial drilling within cylinder head 13, and may be hydraulically coupled to switching gallery 344 at a due to the space constrains of the cylinder head 13. Thus an extra component such as ball plug 352 may be necessary to prevent a direct coupling of priming gallery 346 and switching gallery 344 at a first end 370 of the engine. As described below, a vertical drilling 347 may be configured to couple the priming gallery and the switching gallery toward a second end 372 of the engine.

Hydraulic line 338 may be a vertical drilling into the cylinder head 13, and may be sealed from the atmosphere by the bottom horizontal face the camshaft carrier 14. Hydraulic line 338 is downstream of line 336, and upstream of priming gallery 346. Line 338 may be configured to receive oil directly from line 336, and may be configured to provide hydraulic fluid directly to priming gallery 346. Thus line 338 may directly couple line 336 to priming gallery 346.

Turning now to priming gallery 346, it extends along the axial direction of the engine block, and a priming gallery may be provided for each of the intake and exhaust ends of a bank of cylinders. In this way, the priming gallery may be positioned parallel and adjacent to the axial portion 344*b* of the switching gallery. Thus, the drilling length of vertical drilling 347 that couples the priming gallery to the switching gallery may be reduced. When the VDE OCV (not pictured) is de-energized, hydraulic fluid may be configured to flow through priming gallery 346 from a first end 370 toward a second end 372 at a lower pressure. Conversely, when the VDE OCV is energized, hydraulic fluid may be configured to flow through priming gallery 346 from the second end 372 toward the first end 370 at a higher pressure.

In some examples, the axial drilling of priming gallery 346 may inadvertently establish a fluidic communication between switching gallery 344 and the priming gallery at a position other than the vertical drilling 347. As an example, the inadvertent communication may couple the priming gallery to the switching gallery at a first end 370 of the switching gallery, which is located immediately upstream of the axial portion 344*b* of the switching gallery. Inadvertent communication at the first end of the switching gallery may reduce the promotion of air pockets away from the switching gallery 344, which is an undesired effect. Thus, to prevent any fluidic communication between priming gallery 346 and switching gallery 344 at a first end 370 of the engine, a ball plug 352 may be implemented at the intersection of the aforementioned galleries. It will be appreciated that in other examples, a different means may be implemented for the prevention of hydraulic communication between priming gallery 346 and switching gallery 344 at a first end 370. In this way, by only allowing hydraulic communication between the switching gallery and the priming gallery to occur via vertical drilling 347, the flow of air away from valve deactivation components may be improved.

A vertical drilling 347 may couple priming gallery 346 to the axial portion 344*b* of the switching gallery. Switching gallery 344*b* is shown intersecting the switching ports 354 (analogous to switching ports 220 at FIG. 2) of a plurality of dual-function hydraulic lash adjusters (not shown). The plurality of dual-function hydraulic lash adjusters may supply oil to a plurality of oil-pressure actuated latch pins within latch pin hydraulic chambers of switching roller finger followers, said switching rolling finger followers in direct fluid communication with the dual-function hydraulic lash adjusters. In this way, oil supplied to switching gallery 344*b* may be provided to a plurality of oil-pressure actuated latch pins within latch pin hydraulic chambers of switching roller finger followers, allowing for the activation and deactivation of VDE cylinders.

The axial portion 344*b* of the switching gallery is fluidically connected to a pressure relief valve within a VDE OCV via a vertical portion 344*c* of the switching gallery. In one example, vertical drilling 347 may intersect switching gallery 344*b* further toward second end 372 of the engine than the last switching port 354. It will be understood that when the VDE OCV (not shown) is energized, vertical drilling 347 is downstream of each switching port 354 with regard to the flow of hydraulic fluid, while when the VDE OCV is de-energized, vertical drilling 347 is upstream of each switching port 354 with regard to the flow of hydraulic fluid. In this way, hydraulic fluid from priming gallery 346 may be delivered to switching gallery 344 via vertical drilling 347, upstream of any pockets of air within switching gallery 344 or switching ports 354. Thus, when the VDE OCV is de-energized, any air pockets may be carried by the hydraulic flow toward the pressure relief valve within the VDE OCV and purged from the switching gallery and valve deactivation components.

It will be appreciated that in some examples, priming gallery 346 may be positioned vertically below the axial portion 344*b* of the switching gallery. In this way, air may be further promoted to flow from the switching gallery toward the pressure relief valve in the VDE OCV rather than toward the priming gallery due to its lower density as compared to the density of a hydraulic fluid.

It will be noted that a number of features of the contemplated invention promote the flow of air from the switching gallery to the pressure relief valve of the VDE OCV when the VDE OCV is in a de-energized state. For instance, maintaining a pressure differential across the annular hydraulic flow restrictor promotes the flow of hydraulic fluid from priming gallery 346 toward axial switching gallery 344*b* via vertical drilling 347. Further, the coupling of priming gallery 346 to axial switching gallery 344*b* upstream of each switching port 354 (e.g., via vertical drilling 347) allows for the flow of oil towards the pressure relief valve to purge air from each dual-function HLA in addition to air within the switching gallery itself. By promoting the flow of air from the switching gallery to the priming gallery when the rocker arms are in a latched mode, oil compression times may be improved when switching the rocker arms from a latched mode to an unlatched mode via an oil-pressure actuated latch pin. By drilling the priming gallery vertically beneath each of the switching gallery and the pressure relief valve, the low density of air may be utilized to further promote the evacuation of air from the switching gallery. It will be appreciated that in some examples, the implementations of the hydraulic circuit described herein may be further optimized by reducing the volume of the priming gallery and reducing the number of bends in the path throughout the priming circuit, thereby reducing the influence of the priming gallery on the switching functionality of the switching gallery. By reducing the number of bends within the priming circuit, each of the priming gallery and switching gallery may be quickly filled with a high-pressure hydraulic flow upon energizing a VDE OCV. By reducing the influence of the priming gallery on the switching gallery, the amount of air within the switching gallery may be reduced while maintaining desired amounts of hydraulic volume and hydraulic flow within the switching gallery.

As immediately shown in FIGS. 1-6, the present invention thus contemplates a hydraulic circuit for a poppet valve deactivation mechanism of an engine, comprising a total number of oil-pressure actuated latch pins within a total number of latch pin hydraulic chambers of a total number of switching roller finger followers, a plurality of hydraulic lash adjusters including a total number of dual-function hydraulic lash adjusters, a total number of switching roller finger followers equaling the total number of dual-function hydraulic lash adjusters of the engine, a first hydraulic channel for providing oil pressure for a lash compensation functionality of the plurality of hydraulic lash adjusters (e.g., between 0.5 and 2.0 bar), a second hydraulic channel, in parallel with the first hydraulic channel, for controlling the supply of hydraulic pressure to a plurality of latch pins hydraulic chambers at one of a first or second pressure, the second pressure greater than the first pressure (e.g., the first pressure is between 0.1 and 0.5 bar, and the second pressure is between 2 and 4 bar), a third hydraulic channel, fluidly connected to the second hydraulic channel, for promoting a flow of entrapped air from the second hydraulic channel to an engine crankcase when the supply of hydraulic pressure is controlled at the first pressure. In some examples, the contemplated hydraulic circuit of the present invention may further comprise the total number of dual-function hydraulic lash adjusters fluidly coupling the total number of latch pin hydraulic chambers to the second hydraulic channel, and a perpendicular drilling fluidly coupling the second hydraulic channel chamber to the third hydraulic channel. In some examples, the contemplated hydraulic circuit of the present invention may further comprise the first hydraulic channel beginning at a hydraulic lash adjuster oil supply and ending at a plurality of low pressure hydraulic lash adjuster ports. In some examples, the hydraulic circuit of the present invention may further comprise the second hydraulic channel beginning at a VDE oil control valve and ending at a total number of high pressure hydraulic lash adjuster ports. In some examples, the contemplated hydraulic circuit of the present invention may further include, wherein the third hydraulic channel begins at a hydraulic flow restrictor configured between a VCT oil control valve body and a mating bore of the VCT oil control valve and ends at the perpendicular drilling, wherein the second hydraulic channel begins at the perpendicular drilling and ends at a pressure relief valve within a VDE oil control valve, and wherein the hydraulic flow restrictor supplies the first pressure to the second hydraulic channel. One or more of the aforementioned example hydraulic circuits may further comprise wherein the pressure relief valve is configured to release pressure at a threshold pressure that is high enough to promote flow across the valve, but low enough to avoid inadvertent unlatching of the SRFF latch pin. In one example, the unlatching (e.g., actuation) of the SRFF latch pin may occur at a third pressure, different than the first and second pressures within the switching gallery, and the threshold pressure of the pressure relief valve may be greater than the first pressure and less than the third pressure. As another example, the threshold pressure may be greater than the first pressure in the switching gallery. In a still further example, the threshold pressure may be equal to the first pressure in the switching gallery.

FIG. 7 provides an example routine 700 for operating the valve deactivation hydraulic circuit described with reference to FIG. 2, and further illustrated at FIGS. 1 and 3-6. In one example, an engine system including the presently contemplated poppet valve deactivation hydraulic circuit may further comprise a controller with computer readable instructions stored on non-transitory memory for executing routine 700.

Routine 700 begins with the VDE cylinders activated and the VDE OCV (e.g., 210 at FIG. 2) de-energized. At 702, the hydraulic lash adjuster (e.g., HLA 230 at FIG. 2) is supplied a lower hydraulic pressure via the switching gallery (e.g., gallery 214 at FIG. 2). Specifically, hydraulic fluid at a predetermined pressure may be pumped toward an annular hydraulic flow restrictor incorporated between a VCT OCV valve body and a mating bore of the VCT OCV (e.g., via oil pump 202 at FIG. 2), and the annular restrictor may provide a priming gallery (e.g., gallery 216 at FIG. 2) with hydraulic fluid at the lower amount of hydraulic pressure. Thus the lower amount of hydraulic pressure is a restricted amount of pressure and is provided via a restricted flow of hydraulic fluid. Priming gallery may provide the switching gallery with the lower amount of pressure via perpendicular drilling located at a second end of the switching gallery (e.g., perpendicular drilling 217 at FIG. 2). The switching gallery may deliver hydraulic fluid at the lower amount of pressure to a pressure relief valve within a VDE OCV (e.g., pressure relief valve 244 within VDE OCV 210 at FIG. 2). In this way, a first lower pressure may be provided to a latch pin hydraulic chamber within a valve deactivation mechanism (e.g., within SRFF 232 at FIG. 2) while the VDE OCV is de-energized, and any air that may be entrapped within an HLA switching gallery may be promoted to flow to the pressure relief valve via the hydraulic fluid provided by the priming gallery at the second lower hydraulic pressure.

At 704, it is determined whether valve deactivation conditions are met. Valve deactivation conditions may include an engine load being below a threshold load. If valve deactivation conditions are met, routine 700 proceeds to 706. Otherwise, routine 700 proceeds to 708.

At 706, a higher hydraulic pressure is supplied to the HLA switching gallery. As one example, the higher hydraulic pressure may be supplied by switching a VDE OCV from a de-energized state to an energized state, thereby promoting hydraulic fluid at the higher hydraulic pressure to flow from the VDE OCV toward the HLA switching gallery. In this way, the unlatching of the inner and outer arms of the SRFF may be realized, and the poppet valve may be deactivated. Further, the duration between supplying the higher hydraulic pressure to the HLA and the unlatching of the inner and outer arms of the SRFF may be reduced because of the lower pressures maintained in the hydraulic circuit at 702. It will be appreciated that the higher pressure hydraulic fluid flows through the HLA switching gallery in the opposite direction of the flow of the hydraulic fluid at the first hydraulic pressure, as shown between FIGS. 2A and 2B. After 706, routine 700 terminates.

Thus the present invention contemplates a method for a valve deactivation mechanism, comprising supplying a first amount of oil pressure to a switch of a rocker arm via a first hydraulic lash adjuster oil gallery; selectively further supplying a second amount of oil pressure, greater than the first amount of oil pressure, to the switch of the rocker arm via a second hydraulic lash adjuster oil gallery; and supplying a third amount of oil pressure, less than each of the first and second amounts of oil pressure, to a first priming gallery in fluidic communication with the switch of the rocker arm via pressure release galleries, said priming gallery fluidically separated from the first and second hydraulic lash adjuster oil galleries. The method includes where the second hydraulic lash adjuster oil galleries is supplied oil pressure via a VDE OCV, and where oil pressure is supplied to the second hydraulic lash adjuster oil gallery only during cylinder deactivation conditions. The method further includes where the priming gallery is supplied oil pressure from a high pressure VCT oil supply via a hydraulic flow restrictor within a VCT OCV, and where the priming gallery directs entrapped air from each of the hydraulic lash adjuster and the switch of the rocker arm to a pressure relief valve within the VDE OCV. The method also includes where the rocker arm is one of a plurality of rocker arms which actuate a plurality of intake valves, and where a second plurality of rocker arms are in fluid communication with a second priming gallery.

The technical effect of providing a priming gallery for promoting air flow away from valve deactivation components is to improve the transition time between activated and deactivated states of a valve actuation mechanism. The technical effect of incorporating a hydraulic flow restrictor into an annular clearance between a VCT oil control valve and its mating bore is to minimize costs associated with manufacturing a flow restrictor with tight tolerances by including the restrictor within engine components already manufactured with tight tolerances. A further technical effect of incorporating the restrictor into the VCT oil control valve is to reduce the amount of drilling between the restrictor and the priming gallery that extends axially near the camshaft. A still further technical effect of incorporating the restrictor into the VCT OCV is to reduce packing constraints associated with hydraulic flow restrictors. Yet another technical effect of incorporating the hydraulic flow restrictor into the VCT OCV is to improve the serviceability of the flow restrictor. The technical effect of providing the hydraulic flow restrictor with oil from a dedicated VCT supply is to reduce the costs of filters associated with a hydraulic flow restrictor. The technical effect of terminating the priming gallery at a pressure relief valve within a VDE oil control valve is to maintain at least a consistent low pressure within the priming gallery.

FIGS. 1-6 show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space therebetween and no other components may be referred to as such, in at least one example.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method for removing entrapped air from oil flowing within valve deactivation hydraulic circuit of an engine, the method comprising:

providing the engine having engine components that include the valve deactivation hydraulic circuit, a cylinder head cap, a variable displacement engine oil control valve (VDE OCV), a variable control timing oil control valve (VCT OCV), a rocker arm, a switch of the rocker arm, a pressure relief valve, and a switch of the pressure relief valve, the cylinder head cap having an inbound interior surface of the cylinder head cap, the valve deactivation hydraulic circuit having a switching gallery and a hydraulic lash adjuster oil gallery and providing oil pressure communication to the switching gallery, the hydraulic lash adjuster oil gallery, the switch of the rocker arm, the switch of the pressure relief valve, the VDE OCV, and the VCT OCV;

supplying a first oil pressure through an annular clearance to the switching gallery when the VDE OCV is in a de-energized state whereby the annular clearance functions as a hydraulic flow restrictor for the oil flow flowing in at least a portion of the valve deactivation hydraulic circuit when the first oil pressure is supplied thereat, the switching gallery receiving the restricted oil flow at the first oil pressure and subsequently supplying at least the first oil pressure to each of the switch of the rocker arm and the switch of the pressure relief valve; and supplying a second oil pressure via the hydraulic lash adjuster gallery when the VDE OCV is in an energized state, the second oil pressure being greater than the first oil pressure, to the switch of the rocker arm.

2. The method of claim 1, wherein oil flow in the valve deactivation hydraulic circuit at the first oil pressure flows from a first end of the hydraulic lash adjuster oil gallery toward a second end of the hydraulic lash adjuster oil gallery, and wherein oil flow in the valve deactivation hydraulic circuit at the second oil pressure flows from the second end of the hydraulic lash adjuster oil gallery toward the first end of the hydraulic lash adjuster oil gallery.

3. The method of claim 2, wherein said oil flow at the first oil pressure has a restricted hydraulic flow output from the annular clearance, and when said restricted hydraulic flow occurs, said annular clearance is located upstream of the switching gallery in relation to said oil flow in the valve deactivation hydraulic circuit at the first oil pressure.

4. The method of claim 3, wherein the switching gallery is in fluidic communication with each of the hydraulic lash adjuster oil gallery and the pressure relief valve, and directs the restricted hydraulic flow from the annular clearance and the entrapped air in the valve deactivation hydraulic circuit to the pressure relief valve.

5. The method of claim 4, wherein the hydraulic lash adjuster oil gallery is directly coupled to the VDE OCV and the second oil pressure is supplied to the hydraulic lash adjuster oil gallery only during deactivation of a variable displacement engine (VDE) cylinder of the engine that is associated and has communication with the rocker arm.

6. The method of claim 5, wherein the VDE OCV is disposed downstream of the hydraulic lash adjuster oil gallery with respect to said oil flow in the valve deactivation hydraulic circuit at the first oil pressure, and the VDE OCV is disposed upstream of the hydraulic lash adjuster oil gallery with respect to said oil flow in the valve deactivation hydraulic circuit at the second oil pressure.

7. The method of claim 1, wherein the rocker arm is one rocker arm of at least one of:

(i) a total number of first rocker arms for actuating a total number of deactivatable intake valves of a bank of engine cylinders of the engine, or (ii) a total number of second rocker arms for actuating actuate a total number of deactivatable exhaust valves of the bank of engine cylinders of the engine.

* * * * *